US011654586B2

(12) United States Patent
Brenner et al.

(10) Patent No.: US 11,654,586 B2
(45) Date of Patent: May 23, 2023

(54) SHAVING APPARATUS

(71) Applicant: HYBRID RAZOR LTD., Haifa (IL)

(72) Inventors: Shai Brenner, Haifa (IL); Shoam Zak, Givat Ela (IL); Aviram Notea, Haifa (IL)

(73) Assignee: HYBRID RAZOR LTD., Haifa (IL)

( * ) Notice: Subject to any disclaimer, the term of this patent is extended or adjusted under 35 U.S.C. 154(b) by 0 days.

(21) Appl. No.: 17/424,021

(22) PCT Filed: Jan. 19, 2020

(86) PCT No.: PCT/IL2020/050079

§ 371 (c)(1),
(2) Date: Jul. 19, 2021

(87) PCT Pub. No.: WO2020/152674

PCT Pub. Date: Jul. 30, 2020

(65) Prior Publication Data

US 2022/0080607 A1 Mar. 17, 2022

Related U.S. Application Data

(60) Provisional application No. 62/806,020, filed on Feb. 15, 2019, provisional application No. 62/795,153, filed on Jan. 22, 2019.

(51) Int. Cl.
*B26B 19/16* (2006.01)
*B26B 19/38* (2006.01)

(52) U.S. Cl.
CPC ..... *B26B 19/16* (2013.01); *B26B 19/386* (2013.01); *B26B 19/3886* (2013.01)

(58) Field of Classification Search
CPC ..... B26B 19/26; B26B 19/16; B26B 19/18; B26B 19/30
(Continued)

(56) References Cited

U.S. PATENT DOCUMENTS 2,233,437 A 3/1943 Todhunter
2,321,932 A 6/1943 Nyhagen
(Continued)

FOREIGN PATENT DOCUMENTS

AU 5211773 A 8/1974
FR 1164550 A 10/1958
WO 2014166350 A1 10/2014

OTHER PUBLICATIONS

PCT International Search Report for International Application No. PCT/IL2020/050079, dated May 5, 2020, 3pp.
(Continued)

*Primary Examiner* — Laura M Lee
(74) *Attorney, Agent, or Firm* — The Roy Gross Law Firm, LLC; Roy Gross

(57) ABSTRACT

A shaving apparatus having a head portion intended for contact with a skin surface to cut hairs growing therefrom. The head portion may include a cylindrical screen and a cutting component located within a cavity defined by the cylindrical screen. The cylindrical screen includes a plurality of openings so that a user's hairs can pass therethrough to be cut by blades of the cutting component. The cylindrical screen may be rotatable about a rotational axis so that as the cylindrical screen is placed into contact with a skin surface and moved therealong, the cylindrical screen is made to rotate about the rotational axis. The shaving apparatus may include a brake sub-system to intermittently reduce a rotational velocity of the cylindrical screen.

29 Claims, 15 Drawing Sheets

(58) Field of Classification Search
USPC ..... 30/43.4, 43.5, 43.8, 346.51, 43.91, 347
See application file for complete search history.

(56) References Cited

U.S. PATENT DOCUMENTS 2,331,646 A * 10/1943 Arey ..... B26B 19/30
30/43.4
2,354,657 A * 8/1944 Arey ..... B26B 19/30
30/43.4
2,355,672 A * 8/1944 Page ..... B26B 19/26
30/43.3
2,365,861 A * 12/1944 Bertil ..... B26B 19/16
30/43.6
2,380,461 A * 7/1945 Pedersen ..... B26B 19/30
30/43.4
2,418,722 A * 4/1947 Page ..... B26B 19/16
30/43.5
2,440,061 A * 4/1948 Page ..... B26B 19/16
30/43.5
2,521,597 A * 9/1950 Moore ..... B26B 19/30
30/346.51
2,595,693 A 5/1952 Norwood
2,645,847 A 7/1953 Slonek et al.
3,406,448 A * 10/1968 Maccarthy ..... B26B 19/26
30/34.2
3,949,469 A * 4/1976 Brauss ..... B26B 19/26
30/43.4
2017/0136636 A1* 5/2017 Zak ..... B26B 21/34

OTHER PUBLICATIONS

PCT Written Opinion for International Application No. PCT/IL2020/050079, dated May 5, 2020, 4pp.
PCT International Preliminary Report on Patentability for International Application No. PCT/IL2020/050079, dated Jul. 27, 2021; 5pp.

* cited by examiner

SHAVING APPARATUS

This application is a National Phase of PCT Patent Application No. PCT/IL2020/050079 having International filing date of a Jan. 19, 2020, which claims the benefit of priority of U.S. Provisional Patent Application No. 62/795,153, filed Jan. 22, 2019 and U.S. Provisional Patent Application No. 62/806,020, filed Feb. 15, 2019, the contents of which are all incorporated herein by reference in their entirety.

BACKGROUND

There are several different types of devices that men and women use to shave body hair. These include disposable razors, electric razors, cartridge razors, safety razors, and straight razors. Electric razors also come in different types, including foil-style electric razors and rotary-style electric razors. In a foil-style electric razor, a thin, perforated, protective metal screen is provided that covers the blades. The blades are sharp reciprocating or oscillating blades that move side-to-side at very high speed behind the protective metal screen. The user's hairs pass through openings in the protective metal screen (which is stationary) and are then cut as the blades oscillate back and forth. In a rotary-style electric razor, there are several circular screens that have an internally spinning cutter blade that cuts the hairs captured by the stationary circular screens. The rotary-style electric razor works similarly to a weed wacker. The circular heads are designed to follow the contours of the user's skin as the razor is moved thereacross.

Existing electric razors have several undesirable side effects, including reduced closeness of the shave when compared to manual razors and skin irritation. Such skin irritation is caused by the mechanical abrasion of rubbing the foil screen against the skin and friction heat transfer to the skin due to the inner blades rubbing against the outer screen. Thus, a need exists for an improved electric razor.

SUMMARY

The present invention is directed to a shaving apparatus having a head portion intended for contact with a skin surface to cut hairs growing therefrom. The head portion may include a screen and a cutting component located beneath the screen. The screen may include a plurality of openings so that a user's hairs can pass therethrough to be cut by blades of the cutting component. The screen may be rotatable about a rotational axis so that as the screen is placed into contact with a skin surface and moved thereal-ong, the screen is made to rotate about the rotational axis. The shaving apparatus may include a power source and an electric motor operably coupled to the power source and to the cutting component. Thus, the cutting component may oscillate along a cutting axis to cut the hairs that pass through the openings in the screen.

In one aspect, the invention may be a cylindrical screen comprising an outer surface, an inner surface defining a cavity, and a plurality of openings, the screen being rotatable about a rotational axis; a cutting component comprising one or more cutting blades located within the cavity of the cylindrical screen, the cutting blades positioned adjacent to the inner surface of the cylindrical screen to cut hairs that pass through the openings in the cylindrical screen; wherein upon placing the outer surface of the cylindrical screen into surface contact with a skin surface and moving the shaving apparatus along the skin surface, the cylindrical screen rotates about the rotational axis; and a brake sub-system configured to reduce a rotational velocity of the cylindrical screen to cause relative motion between the cylindrical screen and the skin surface as the shaving apparatus is moved along the skin surface.

In another aspect, the invention may be a head portion of a shaving apparatus comprising: a mounting portion; a cylindrical screen comprising a plurality of openings, the cylindrical screen rotatably coupled to the mounting portion so as to be rotatable about a rotational axis; a brake sub-system configured to intermittently reduce a rotational velocity of the cylindrical screen; and a cutting component comprising one or more cutting blades, the cutting component configured to cut hairs that pass through the openings in the cylindrical screen.

In yet another aspect, the invention may be a method of shaving comprising: pressing a cylindrical screen of a shaving apparatus into contact with a skin surface, the cylindrical screen comprising a plurality of openings that allow hairs on the skin surface to pass through the cylindrical screen; moving the shaving apparatus along the skin surface while the cylindrical screen is in surface contact with the skin surface, thereby causing the cylindrical screen of the shaving apparatus to rotate about a rotational axis; intermittently reducing a rotational velocity of the cylindrical screen with a brake sub-system that is operably coupled to the cylindrical screen; and cutting the hairs that pass through the cylindrical screen with a cutting component.

According to some embodiments, there is provided herein a shaving apparatus comprising: a cylindrical screen comprising an outer surface, an inner surface defining a cavity, and a plurality of openings, the screen being rotatable about a rotational axis; a cutting component comprising one or more cutting blades located within the cavity of the cylindrical screen, the cutting blades configured to cut hairs that pass through the openings in the cylindrical screen; wherein upon placing the outer surface of the cylindrical screen into surface contact with a skin surface and moving the shaving apparatus along the skin surface, the cylindrical screen rotates about the rotational axis; and a brake sub-system configured to reduce a rotational velocity of the cylindrical screen to cause relative motion between the cylindrical screen and the skin surface as the shaving apparatus is moved along the skin surface.

According to some embodiments, there is provided herein a head portion of a shaving apparatus comprising: a mounting portion; a cylindrical screen comprising a plurality of openings, the cylindrical screen rotatably coupled to the mounting portion so as to be rotatable about a rotational axis; a brake sub-system coupled to the cylindrical screen and configured to intermittently reduce a rotational velocity of the cylindrical screen; and a cutting component comprising one or more cutting blades, the cutting component configured to cut hairs that pass through the openings in the cylindrical screen. According to some embodiments, the cylindrical screen is configured to rotate about the rotational axis, relative to the mounting portion, in response to a linear force being applied thereto.

According to some embodiments, the cylindrical screen may be a foil screen having a thickness of less than about 0.1 mm, for example, less than about 0.09 mm, less than about 0.075 mm or less than about 0.05 mm.

According to some embodiments, the shaving apparatus may further include a head portion comprising the cylindrical screen and the cutting component and a handle portion coupled to the head portion and configured for gripping by a user.

According to some embodiments, the shaving apparatus may further include a power source; and an electric motor operably coupled to the power source and to the cutting component to oscillate the cutting component along a cutting axis to cut hairs that pass through the openings in the cylindrical screen. According to some embodiments, the power source and the electric motor are located within the handle portion.

According to some embodiments, the head portion may further include a mounting portion, the cylindrical screen rotatably coupled to the mounting portion.

According to some embodiments, the cylindrical screen may be freely rotatable relative to the mounting portion.

According to some embodiments, the cylindrical screen is not operably coupled to a motor.

According to some embodiments, the cylindrical screen may be made to rotate about the rotational axis manually due to a linear movement of the shaving apparatus along the skin surface.

According to some embodiments, the brake sub-system may include an activation mechanism operable by a user. The activation mechanism may include a push button. Such that, for example, in operation, when the user wishes to reduce or stop the rotational velocity of the cylindrical screen (to cause relative motion between the cylindrical screen and the skin surface), they press the push button and when the wish to allow the rotation of the cylindrical screen, they release the button.

According to some embodiments, the activation mechanism may be located on a head portion or on a handle portion coupled to the head portion of the shaving apparatus.

According to some embodiments, there is provided herein a method of shaving comprising: pressing a cylindrical screen of a shaving apparatus into contact with a skin surface, the cylindrical screen comprising a plurality of openings that allow hairs on the skin surface to pass through the cylindrical screen; moving the shaving apparatus along the skin surface while the cylindrical screen is in surface contact with the skin surface, thereby causing the cylindrical screen of the shaving apparatus to rotate about a rotational axis; intermittently reducing a rotational velocity of the cylindrical screen with a brake sub-system that is operably coupled to the cylindrical screen; and cutting the hairs that pass through the cylindrical screen with a cutting component.

According to some embodiments, the method may further include powering a motor of the shaving apparatus to cause the cutting component of the shaving apparatus to oscillate along a linear axis to facilitate cutting of the hairs by the cutting component.

According to some embodiments, there is intermittent relative motion between the cylindrical screen and the skin surface as the shaving apparatus is moved along the skin surface.

According to some embodiments, the intermittent relative motion between the cylindrical screen and the skin surface is operated and controlled by the user.

According to some embodiments, the cylindrical screen rotates about the rotational axis entirely due to the movement of the shaving apparatus along the skin surface while the cylindrical screen is in surface contact with the skin surface.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
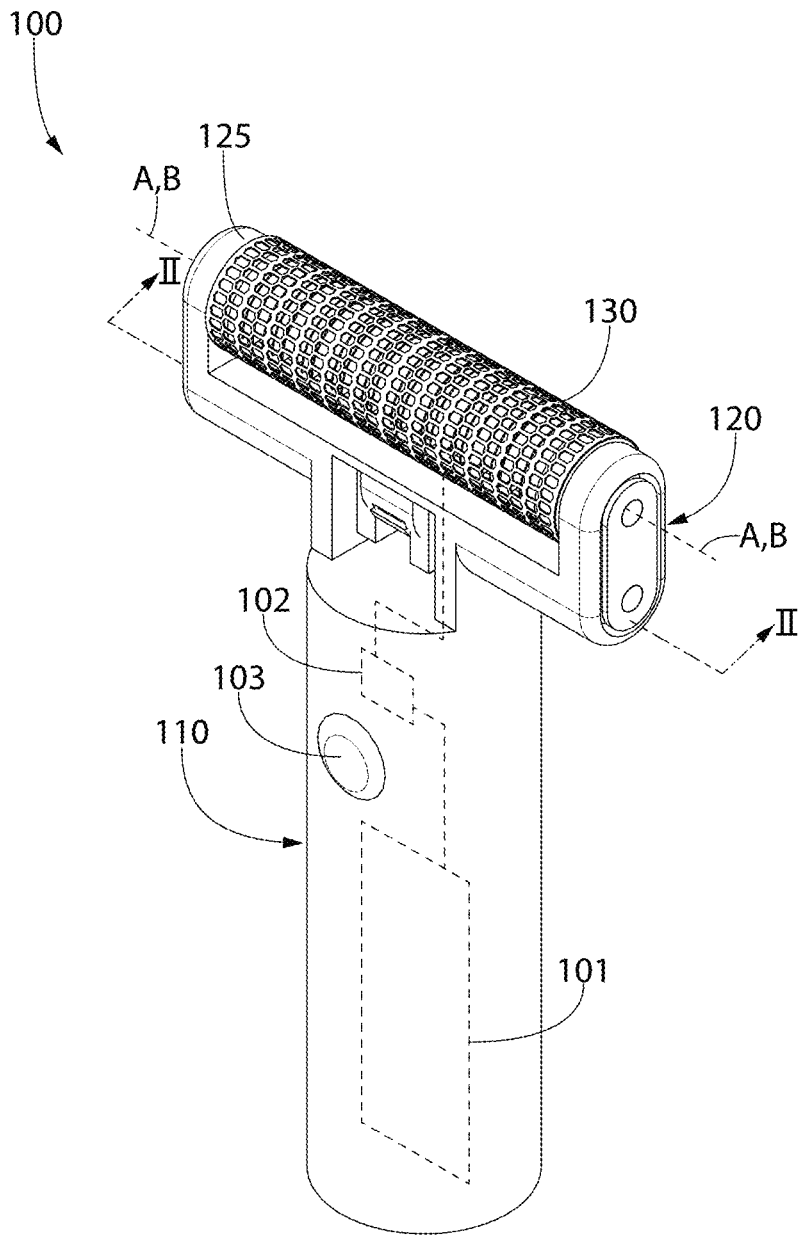
FIG. 1 is a perspective view of a shaving apparatus in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
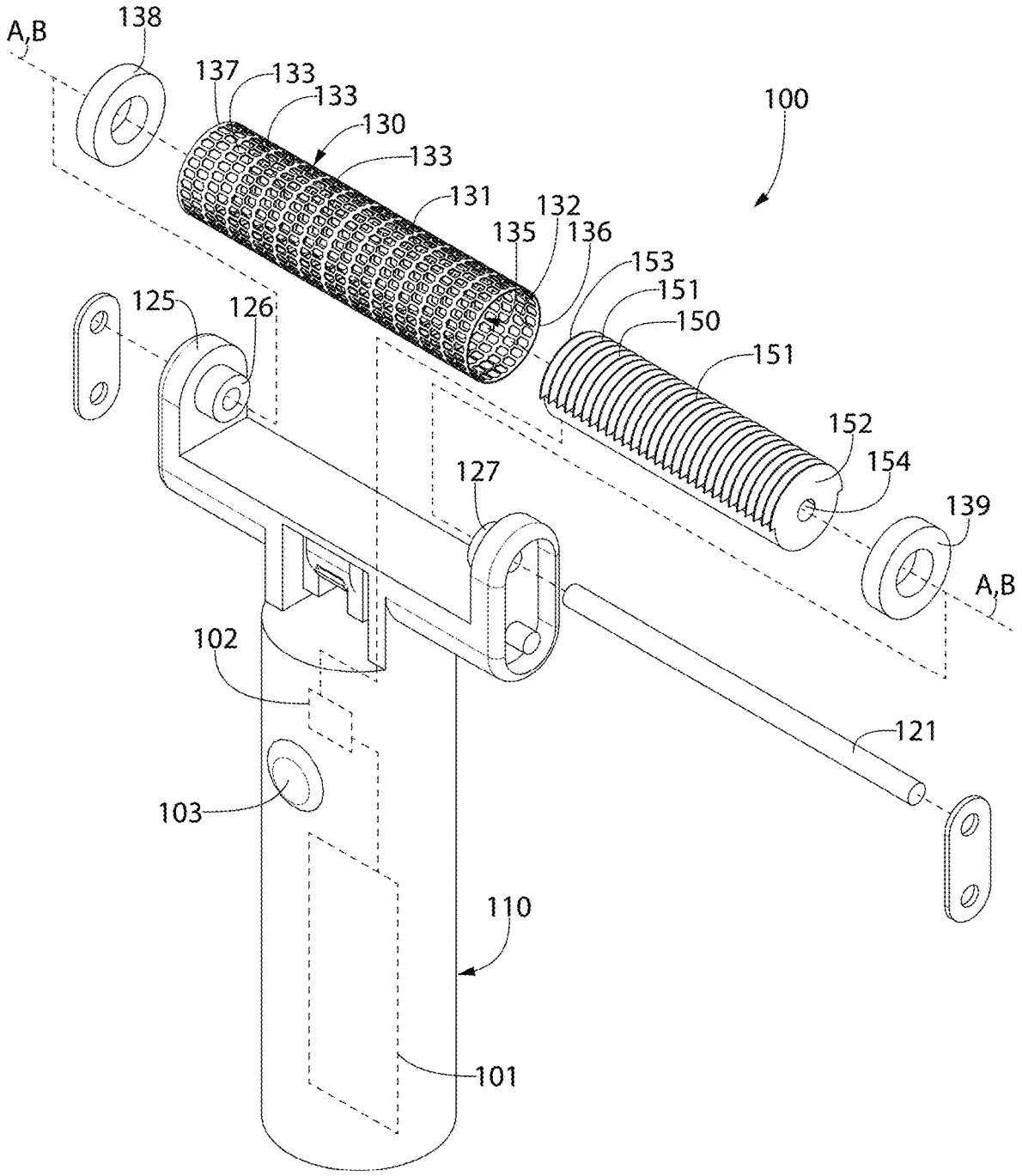
FIG. 2 is an exploded perspective view of the shaving apparatus of FIG. 1.

Referring first to FIGS. 1 and 2, a shaving apparatus 100 is illustrated in accordance with an embodiment of the present invention. The shaving apparatus 100 generally comprises a handle portion 110 and a head portion 120. The handle portion 110 is the part that is gripped by a user during shaving and the head portion 120 is the portion that performs the cutting operation. The head portion 120 may be permanently or detachably coupled to the handle portion 110.

In the exemplified embodiment, the shaving apparatus 100 is an electrically operated device that includes a power source 101 and an electric motor 102 that are operably coupled together. Of course, the invention is not to be so limited and the shaving apparatus 100 could be a manual device in other embodiments. Furthermore, an electric motor and/or power source may not be required in all embodiments. The power source 101 may be batteries or similar devices that are capable of supplying power to the electric motor 102. In the exemplified embodiment, the power source 101 is located within the handle portion 110 of the shaving apparatus 100. However, the invention is not to be so limited in all embodiments and the power source 101 could be located within the head portion 120 or within another component or housing. Furthermore, in still other embodiments the shaving apparatus 100 may not include an internal power source, but may instead include a plug that is configured to be plugged into a wall outlet for powering the electric motor.

In the exemplified embodiment, the electric motor 102 is also located within the handle portion 110 of the shaving apparatus 100. However, in other embodiments the electric motor 102 could be located within the head portion 120 of the shaving apparatus 100. Regardless of the exact location and positioning of the electric motor 102 and the power source 101, they should be operably coupled together so that power from the power source 101 can be transmitted to the electric motor 102 to facilitate its operation.

In the exemplified embodiment, an actuator 103 is located on the handle portion 110 for activating the electric motor 102. Specifically, in the exemplified embodiment the actuator 103 is a button located on the handle portion 110 that upon being depressed by a user will activate and deactivate the electric motor 102. Thus, pressing the actuator 103 a single time will activate the electric motor 102 by transmitting power from the power source 101 to the electric motor 102 and pressing the actuator 103 a second time will deactivate the electric motor 102. Although depicted as a depressible button in the exemplified embodiment, the actuator 103 can take on other forms such as being a slide switch, a conductive switch, a dial switch, a pressure switch, a temperature switch, a toggle switch, a rotary switch, or the like.

The head portion 120 of the rotary cutter 100 comprises a mounting portion 125, a screen 130 and a cutting component 150. In the exemplified embodiment, the mounting portion 125 of the head portion 120 is formed integrally with the handle portion 110 and the screen 130 and the cutting component 150 are not integral with the handle portion 110 but are separately coupled to the mounting portion 125. In other embodiments, the mounting portion 125 may be detachable from the handle portion 110.

The mounting portion 125 comprises features and/or structures that facilitate the mounting of the screen 130 and the cutting component 150 thereto. Specifically, in the exemplified embodiment the mounting portion 125 comprises a first mounting protuberance 126 and a second mounting protuberance 127. Each of the first and second mounting protuberances 126, 127 interact with the screen 130 to mount the screen to the mounting portion 125.

In the exemplified embodiment, the screen 130 is a foil screen, which may be formed from a metal material such as aluminum or the like. Furthermore, in the exemplified embodiment the screen 130 is in the shape of a cylinder. In that regard, the screen 130 comprises an outer surface 131 that comes into contact with a user's skin during shaving, an inner surface 132, and a plurality of openings or perforations 133 extending through the screen 130 from the outer surface 131 to the inner surface 132. The screen 130 further comprises an inner cavity 135 that is bounded by the inner surface 132. Thus, the screen 130 forms a hollow cylindrical shape with the openings 133 providing passageways from the exterior environment into the inner cavity 135. The screen 130 extends from a first end 136 to a second end 137. In the exemplified embodiment, both of the first and second ends 136, 137 are open.

In the exemplified embodiment, the plurality of openings 133 all have the same shape, which is the shape of a hexagon, and more specifically an elongated hexagon. However, the invention is not to be so limited and the openings 133 can take on any shape including circular, triangular, pentagonal, octagonal, or the like. Furthermore, in some embodiments the openings 133 may have a variation in shape such that some of the openings 133 are circular in shape while others of the openings 133 are polygonal in shape. Thus, the openings 133 can take on any shape so long as they permit a user's hairs to pass through the openings 133 and into the inner cavity 135 for cutting by the cutting component 150 which, as described below, is located within the inner cavity 135.

The first and second mounting protuberances 126, 127 of the mounting portion 125 are positioned within the openings in the first and second ends 136, 137 of the screen 130 to mount the screen 130 to the mounting portion 125. More specifically, in the exemplified embodiment a first end cap 138 is positioned within the inner cavity 135 of the screen 130 at the first end 136 of the screen 130 and a second end cap 139 is positioned within the inner cavity 135 of the screen 130 at the second end 137 of the screen 130. The first and second mounting protuberances 126, 127 are received within openings in the first and second end caps 138, 139. The screen 130 is not otherwise fixed to the mounting portion 125, and thus the screen 130 is free to rotate relative to the mounting portion 125 about a rotational axis B-B. Thus, for example, if a user were to place their finger against the screen 130 and flick their finger in a downward or upward motion, the screen 130 would rotate about the rotational axis B-B relative to the mounting portion 125, which would remain stationary.

The cutter component 150 is the component of the shaving apparatus 100 that cuts the user's hairs upon contact therewith. Specifically, the cutter component 150 comprises a plurality of cutting blades 151 that are capable of cutting a user's hair during operation of the shaving apparatus 100 as described more fully herein below. In the exemplified embodiment the cutter component 150 is located within the inner cavity 135 of the screen 130. The cutter component 150 extends along a cutting axis A-A from a first end 152 thereof to a second end 153 thereof.

Figure 3A:
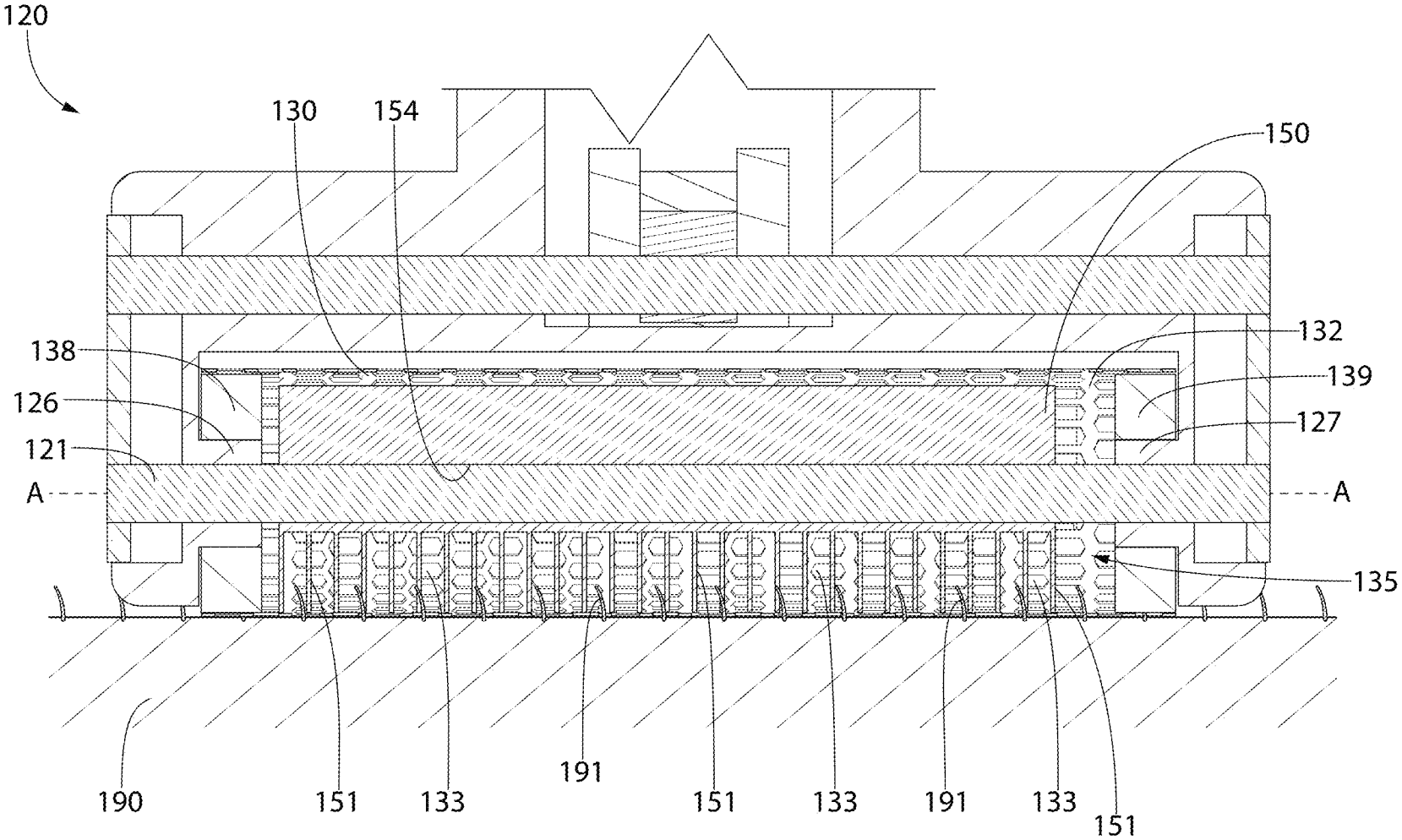
FIGS. 3A and 3B are cross-sectional views of a head portion of the shaving apparatus taken along line of FIG. 1 positioned adjacent to a skin surface illustrating an oscillating movement of a cutting blade of the shaving apparatus.

The cutter component 150 comprises a central bore 154 that extends therethrough. The head portion 120 of the shaving apparatus 100 comprises an elongated rod 121 that is located within the central bore 154 for mounting the cutter component 150 to the mounting portion 125. The elongated rod 121 extends through openings in the first and second mounting protuberances 126, 127 of the mounting portion 125 as best shown in FIG. 3A. As will be described in greater detail below with reference to FIGS. 3A and 3B, the cutter component 150 oscillates back-and-forth along the cutting axis A-A when the shaving apparatus 100, and more particularly the motor 102 thereof, is activated.

Figure 3B:
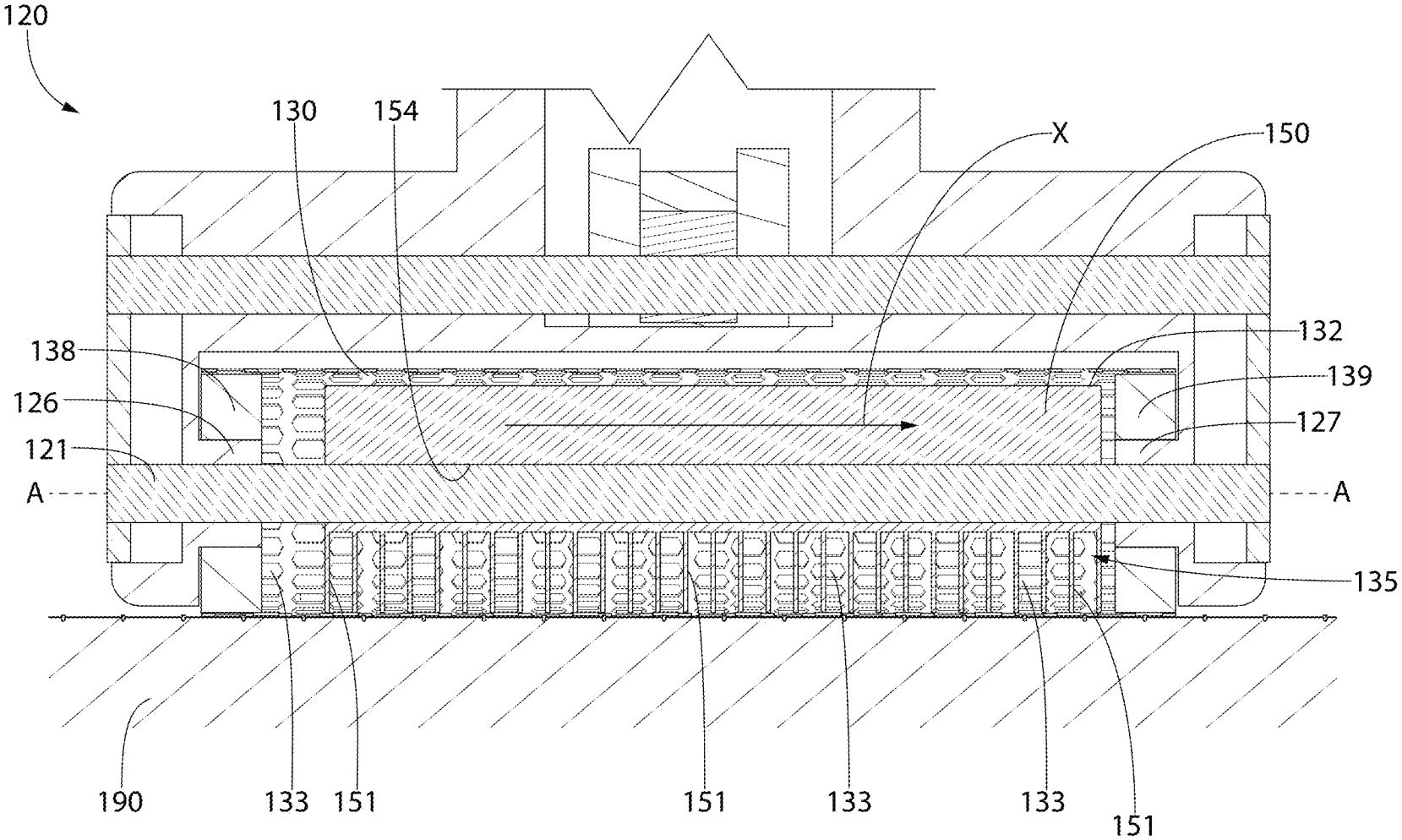

Referring to FIGS. 3A and 3B, the oscillatory or reciprocal movement of the cutter component 150 during shaving or other hair cutting operations will be described. FIGS. 3A and 3B illustrate the shaving apparatus 100 in position for cutting of a user's hair such that the screen 130 is in surface contact or immediately adjacent to a skin surface 190 of a user from which hairs 191 that are desired to be cut are growing or otherwise extending. As seen, the hairs pass through the openings 133 in the screen and into the inner cavity 135 of the screen 130 where they can be engaged by the cutting blades 151 of the cutting component 150.

When the motor 102 is activated, the cutting component 150 is caused to oscillate back-and-forth repetitively along the cutting axis A-A. Thus, looking from FIG. 3A to FIG. 3B, it can be seen that the cutting component 150 has moved linearly to the right in the direction of the cutting axis A-A as depicted by the arrow labeled X. The cutting component 150 will then move linearly to the left and continue to move linearly back-and-forth in an oscillating or reciprocal manner so long as the motor 102 remains activated. As the user moves the shaving apparatus 100 along the skin surface 190, more of the hairs 191 will pass through the openings 133 in the screen 130 and be cut by the cutting blades 151 of the cutting component 150. FIG. 3B illustrates the hairs seen in FIG. 3A having been cut but the cutting blades 151 of the cutting component 150.

Thus, in the exemplified embodiment the motor 102 causes the cutting component 150 to move back and forth for cutting of hairs. However, the invention is not to be so limited in all embodiments. In other embodiments, the cutting component 150 may be moved/driven by a solenoid instead of an electric motor. In other embodiments, the cutting component 150 may be automatically moved in a manual way merely by moving the shaving apparatus 100 across a skin surface during shaving. Thus, for example, gears or the like may be included such that as the shaving apparatus 100 moves across the face, such movement causes the cutting component 150 to move for the cutting of hairs. Basically any technique now known or later discovered may be used for the cutting of hairs with the cutting component.

Figure 4:
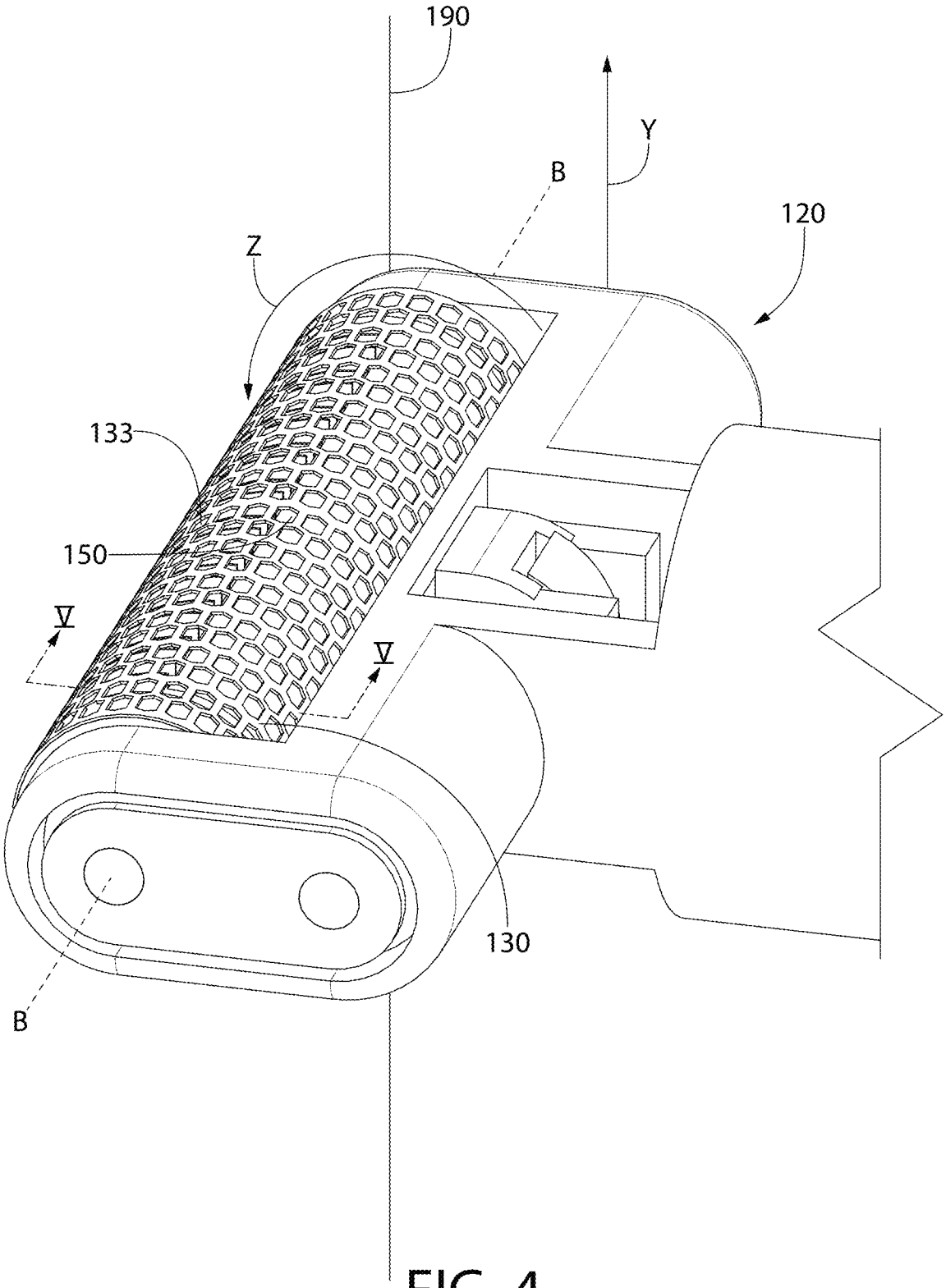
FIG. 4 is a close-up view of the head portion of the shaving apparatus of FIG. 1 illustrating movement a screen of the shaving apparatus as the shaving apparatus moves across a skin surface.

FIG. 4 illustrates the head portion 120 of the shaving apparatus 100 positioned against the skin surface 190 of a user. There is a vertical arrow labeled Y indicating the movement direction of the head portion 120 of the shaving apparatus 100 along the skin surface 190. Furthermore, there is an arrow labeled Z indicating the rotational movement of the screen 130 along the rotational axis B-B. In some embodiments, the rotational axis B-B of the screen 130 may be the same axis as the cutting axis A-A of the cutting component 150.

Figure 5B:
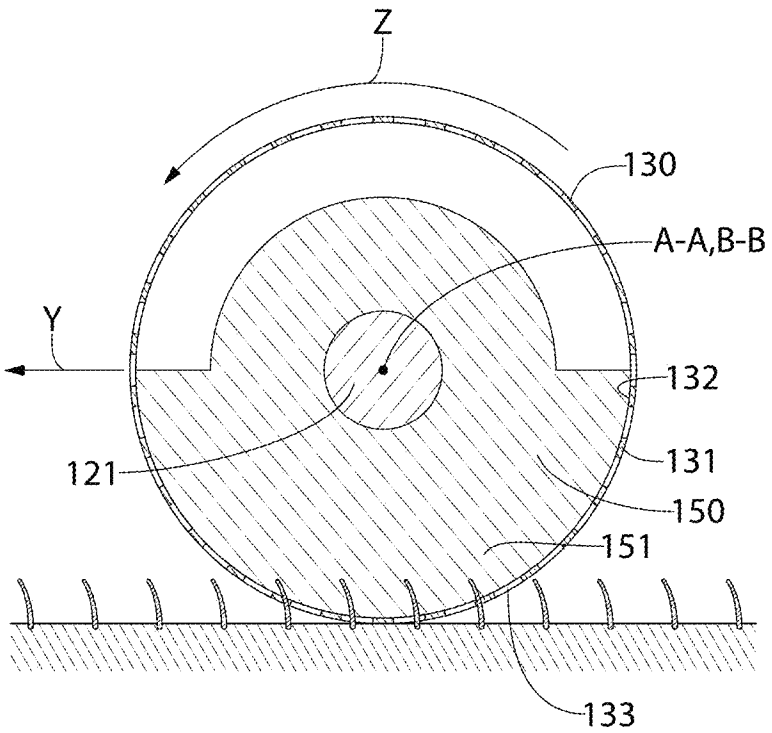
FIGS. 5A and 5B are cross-sectional views taken along line V-V of FIG. 4 illustrating the movement of the screen of the shaving apparatus as the shaving apparatus moves across the skin surface.
Figure 5A:
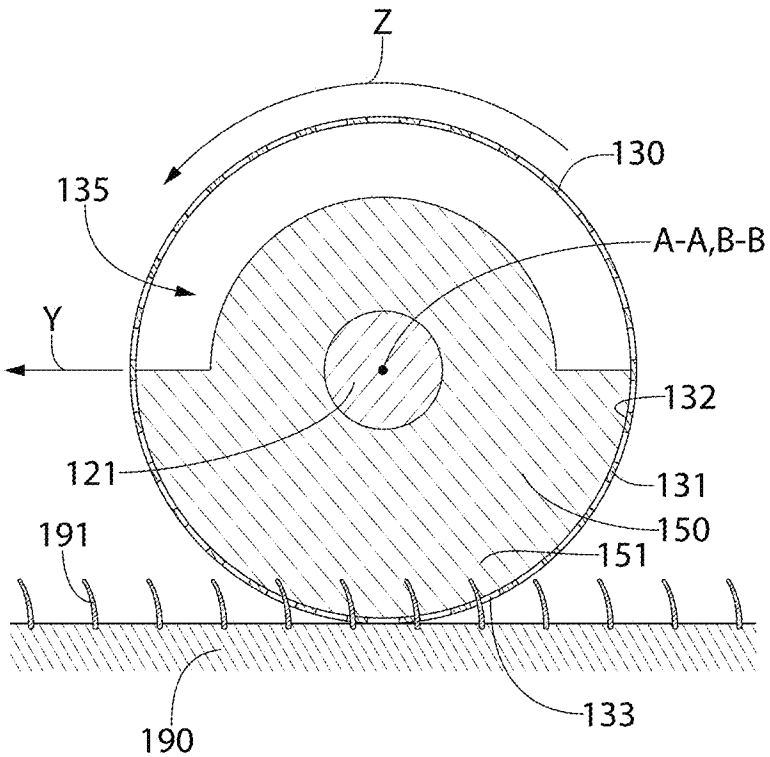

FIGS. 5A and 5B illustrate the rotational movement of the screen 130 in a schematic manner. Specifically, as shown in those figures, the screen 130 is in contact with the skin surface 190 from which hairs 191 are protruding. As the shaving apparatus 100 is moved in the direction of the arrow labeled Y, the screen 130 rotates about the rotational axis B-B in the direction indicated by the arrow labeled Z (i.e., counterclockwise). If the shaving apparatus 100 were moved in the opposite direction, the screen 130 would rotate in the opposite rotational direction (i.e., clockwise).

At the same time, the cutting component 150 oscillates back-and-forth along the cutting axis A-A to cut the hairs 191 that are passing through the openings 133 in the screen 130. Thus, the screen 130 is not stationary, and therefore the screen 130 is not being dragged across the skin surface 190 during shaving. Instead, the screen 130 rotates about the rotational axis B-B as the shaving apparatus 100 moves across the skin surface so that there is no relative motion between the screen 130 and the skin surface 190 during use. As a result, skin irritations can be reduced if not eliminated altogether. Furthermore, the amount of heat that is transferred to the skin due to the interaction between the cutting blades 151 and the screen 130 is reduced. This is because the heat generated by the friction between the cutting blades 151 and the screen 130 dissipates around the entire circumference of the screen 130 instead of being built up at the same area of the screen as occurs with existing designs in which the screen is stationary.

Thus, generally, upon placing the screen 130 into surface contact with the skin surface 190 and moving the head portion 120 of the shaving apparatus 100 linearly along the skin surface 190, the screen 130 will rotate about the rotational axis B-B. It should be appreciated that the screen 130 is not operably coupled to the motor 102. Thus, the screen 130 is not moving in an automatic way, but rather in a manual way due to the movement of the head portion 120 of the shaving apparatus 100 along the skin surface 190. Furthermore, it should be appreciated that in some embodiments the shaving apparatus 100 need not move linearly along the skin surface 190 to cause rotation of the screen 130.

Thus, with references to FIGS. 3A-B and 5A-B, a method of shaving or cutting hair using the shaving apparatus 100 will be briefly described. First, the motor 102 is powered on, such as by depressing or otherwise activating the actuator 103. This powering of the motor 102 causes the cutting component 150 and the cutting blades 151 thereof to oscillate along the cutting axis A-A. Either before the motor 102 is powered on or after, the screen 130 of the shaving apparatus 100 is pressed into contact with the skin surface 190. The skin surface 190 may be a user's leg, arm, underarm, face, head, or the like. Specifically, the skin surface 190 can be any surface of a user's skin from which hair is growing or otherwise extending and which is desired to be cut or trimmed.

As the screen 130 of the shaving apparatus 100 is pressed into contact with the skin surface 190, hairs 191 on the skin surface 190 will pass through the openings 133 in the screen 130 and into the inner cavity 135 of the screen 130. These hairs 191 that pass into the inner cavity 135 are then cut by the cutting blades 151 of the cutting apparatus 150 as the cutting apparatus 150 oscillates as described herein. Next, the shaving apparatus 100 is moved along the skin surface 190, preferably but not necessarily in a linear direction. As this occurs, the screen 130 of the shaving apparatus 100 rotates about the rotational axis B-B due to the rotational coupling between the screen 130 and the mounting portion 125 of the head portion 120 of the shaving apparatus 100. Because the screen 130 rotates as described herein, there is no relative motion between the screen 130 and the skin surface 190 and irritation to the skin surface 190 can be reduced or eliminated.

FIGS. 6-21 build on the description above, by including features such as relative motion between a screen and a skin surface, partial rolling, mixed rolling, and rolling/skidding. This will be described in greater detail below.

Figure 6:
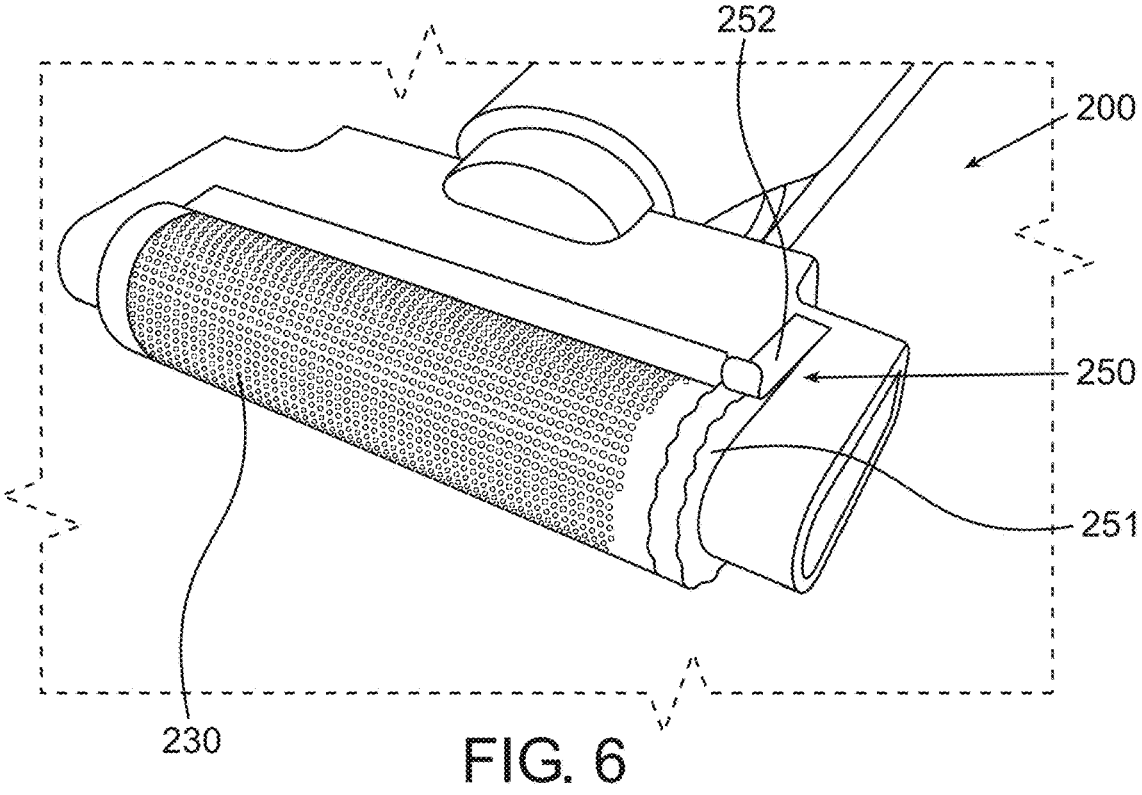
FIG. 6 is a perspective view of a shaving apparatus in accordance with another embodiment of the present invention, the shaving apparatus including a cylindrical screen and a brake sub-system.
Figure 7:
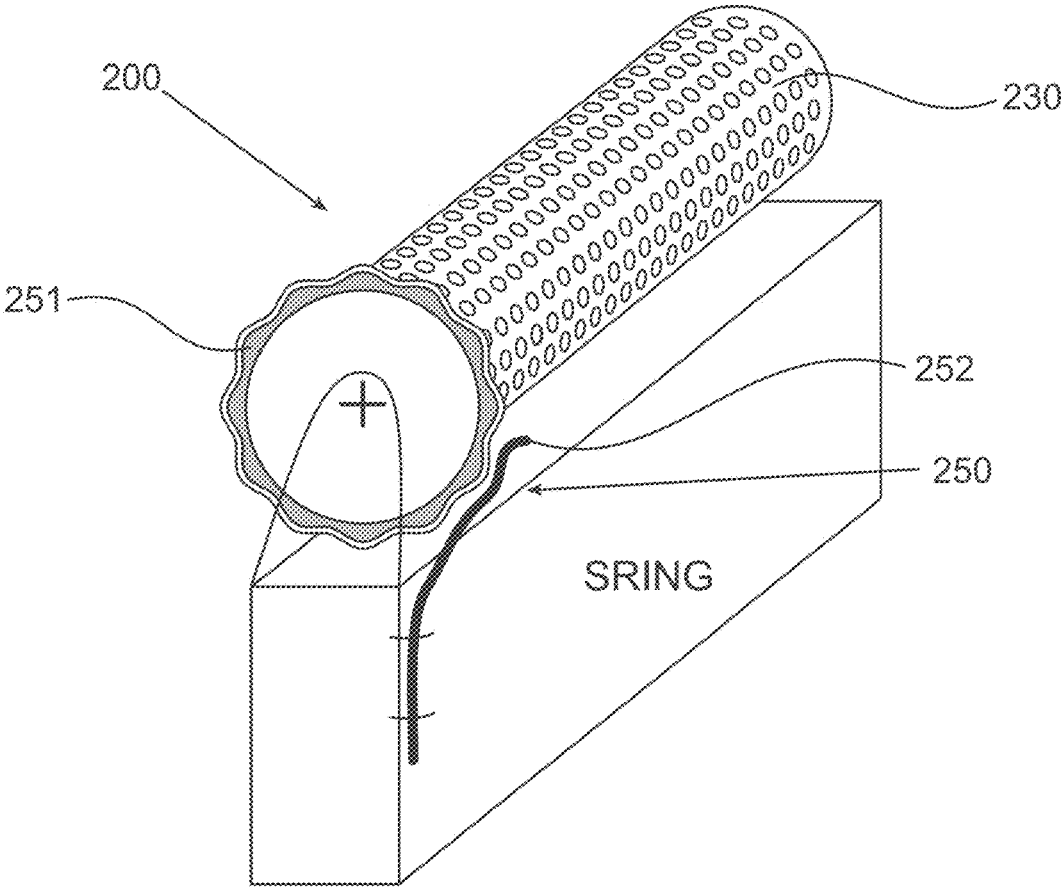
FIG. 7 is a schematic illustration of the shaving apparatus of FIG. 6.

FIGS. 6 and 7 depict a shaving apparatus 200 having a cylindrical screen 230 having an inner surface that defines a cavity. The inner surface and cavity are not shown, but it should be appreciated that the description of the shaving apparatus 100 above is applicable for these features. The cylindrical screen 230 is generally identical to the screen 130 described above. A cutting component is located within the cavity of the cylindrical screen 230 much like with the previously described embodiments. Thus, the details of the cylindrical screen 230 and the cutting component will not be provided below, it being understood that the description above is entirely applicable.

The cylindrical screen 230 may have a thickness, measured between the inner and outer surfaces thereof, of less than 0.1 mm, and more specifically between 0.03 mm and 0.07 mm. This allows a user to get a very close shaving using the shaving apparatus 200. The cylindrical screen 230 is rotatable about a rotational axis just like the cylindrical screen 230. However, in this embodiment of the shaving apparatus 200, there is an additional feature that can alter the rotational velocity of the cylindrical screen 230 even if the linear velocity of the cylindrical screen 230 across the skin surface that is being shaved is not changed.

The shaving apparatus 200 comprises a brake sub-system 250 that is configured to reduce the rotational velocity of the cylindrical screen 230 even as a user moves the cylindrical screen 230 linearly across a skin surface (such as a face) at a constant speed. In the exemplified embodiment, the brake sub-system 250 comprises a disc 251 and a brake member 252. In the exemplified embodiment, the brake member 252 is a spring, although the invention is not to be so limited in all embodiments. The disc 251 is coupled to the cylindrical screen 230 so that as the cylindrical screen 230 rotates, so too does the disc. As seen in the figures, the disc 251 has an outer surface with alternating raised portions and valley portions. The brake member 252 has a spring force that forces the brake member 252 into contact with the outer surface of the disc 251. As the disc 251 rotates (due to the rotation of the cylindrical screen 230 as it is dragged across a skin surface), the distal portion of the brake member 252 enters into and out of the valleys of the outer surface of the disc 251. This causes the rotational velocity of the cylindrical screen 230 to be intermittently reduced even as the cylindrical screen 230 is moved across the skin surface at a constant speed. As a result, the cylindrical screen 230 will intermittently: (1) roll along the skin surface as it is moved across the skin surface such that there is no relative movement between the cylindrical screen 230 and the skin surface; and (2) skid or drag along the skin surface as it is moved across the skin surface such that there is relative movement between the cylindrical screen 230 and the skin surface. In some embodiments, the cylindrical screen 230 may constantly rotate as it is moved across the skin surface, but the rotational velocity will change depending on whether the brake member 252 is in contact with a valley or raised portion of the disc 251.

Using the brake sub-system 250 described herein, it is possible to either reduce the rotational velocity of the cylindrical screen 230 or to temporarily stop the rotation of the cylindrical screen 230 even as the cylindrical screen 230 continues to be dragged across the skin surface. When the cylindrical screen 230 is rotating freely without any skid or forces applying a brake to it, this is best for shaving upright hairs (those that extend perpendicularly or close to perpendicularly from the skin surface). When the cylindrical screen 230 is rotating at a reduced rotational velocity or not rotating at all so that there is relative movement between the cylindrical screen 230 and the skin surface as the cylindrical screen 230 is moved across the skin surface, this is better for shaving flat hair. Thus, the invention described herein allows for a combination of rotating the cylindrical screen 230 freely so that there is no relative movement between the cylindrical screen 230 and the skin surface and rotating the cylindrical screen 230 at a reduced rotational velocity (or not rotating the cylindrical screen at all) so that there is relative movement between the cylindrical screen 230 and the skin surface. This achieves the best shaving result for both upright hairs and the hairs that lie flat against the skin surface.

FIGS. 8-13 illustrate alternative brake sub-systems that can be used in conjunction with the teachings set forth herein. Each of the brake sub-systems causes some sort of friction, either continuous or intermittent, between a disc and a brake member.

Figure 8:
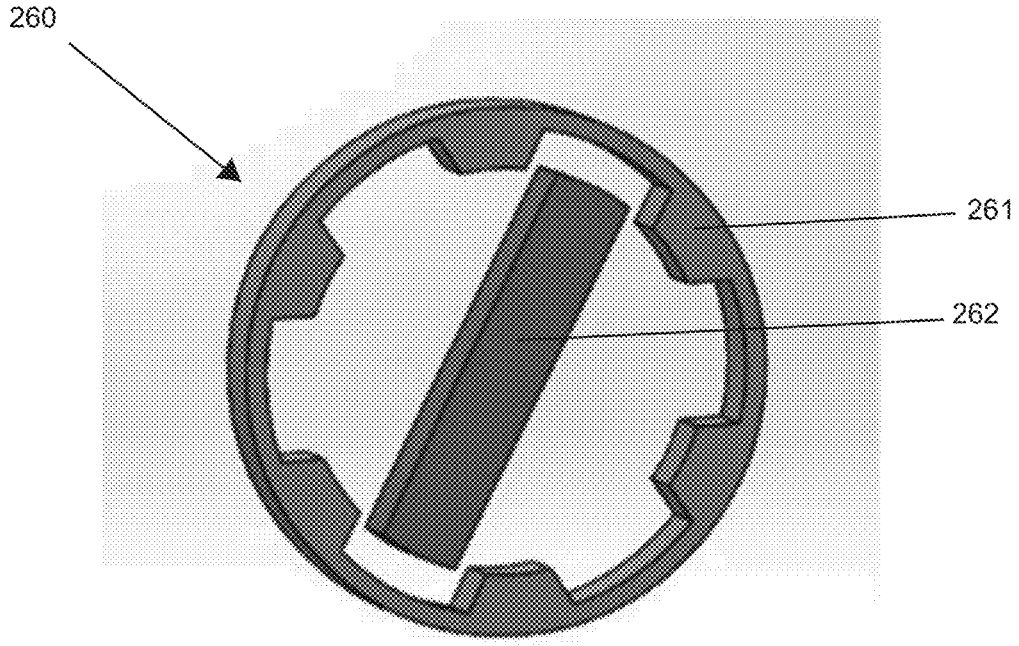
FIGS. 8-13 illustrate alternative brake sub-systems for the shaving apparatus of FIG. 6.

Referring first to FIG. 8, a brake sub-system 260 comprising a disc 261 and a brake member 262 is illustrated. The brake sub-system 260 is an alternative to the brake sub-system 250 depicted in FIGS. 6 and 7. Thus, the brake sub-system 260 can be used in the shaving apparatus 200 by replacing the brake sub-system 250 with the brake sub-system 260. As such, although not illustrated in FIG. 8, the disc 261 is coupled to the cylindrical screen 230 so that the disc 261 rotates along with the cylindrical screen 230. The disc 261 comprises an inner surface having alternating recesses and protrusions.

The brake member 262 is located within the interior of the disc 261 that is defined by the inner surface of the disc 261. The brake member 262 is stationary and does not rotate along with the cylindrical screen 262. Thus, as can be appreciated, as the disc 261 rotates about a rotational axis, opposing ends of the brake member 262 will alternatingly be in contact with the inner surface of the disc 261 and not in contact with the inner surface of the disc 261. When the opposite ends of the brake member 262 are not in contact with the inner surface of the disc 261, the disc 261 and also the cylindrical screen to which it is attached, will rotate freely as they are moved along a skin surface. When the opposite ends of the brake member 262 are in contact with the inner surface of the disc 261, the friction between the brake member 262 and the disc 261 will retard the rotational velocity of the disc 261 (and the cylindrical screen). Thus, the rotational velocity of the disc 261 and the cylindrical screen will be intermittently reduced depending on whether the opposing ends of the brake member 262 are aligned with the protrusions or the recesses in the inner surface of the disc 261.

Figure 9:
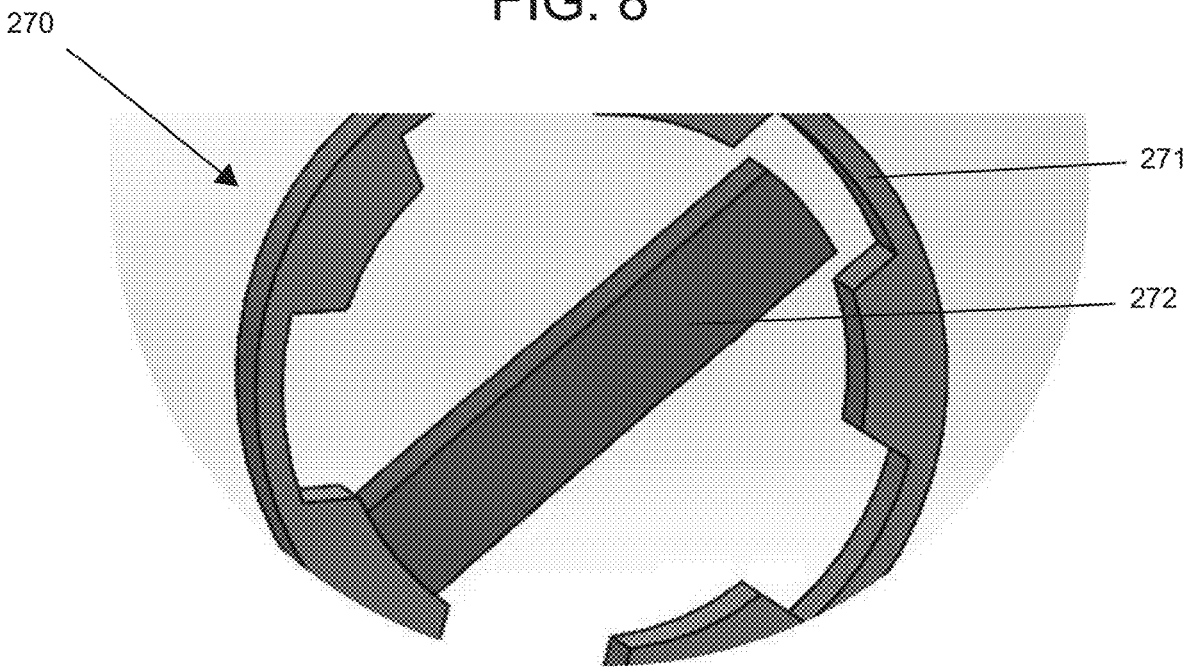

Referring to FIG. 9, a brake sub-system 270 is illustrated. The brake sub-system 270 is very similar to the brake sub-system 260. The brake sub-system 270 comprises a disc 271 that is coupled to the cylindrical screen and a brake member 272 that is in frictional contact with an inner surface of the disc 271. The difference is that in this embodiment one of the ends of the brake member 272 is always in contact with the inner surface of the disc 271. Thus, when a first end of the brake member 272 is in contact with the inner surface of the disc 271, the second end of the brake member 272 is not, and vice versa. As a result, the rotational velocity of the disc 271 and the cylindrical screen to which it is attached is constantly retarded or reduced. Thus, there will always be some relative movement between the cylindrical screen and the skin surface as the cylindrical screen is moved across the skin surface because the rotation of the cylindrical screen is constantly being reduced due to the frictional engagement between the disc 271 and the brake member 272.

Figure 10:
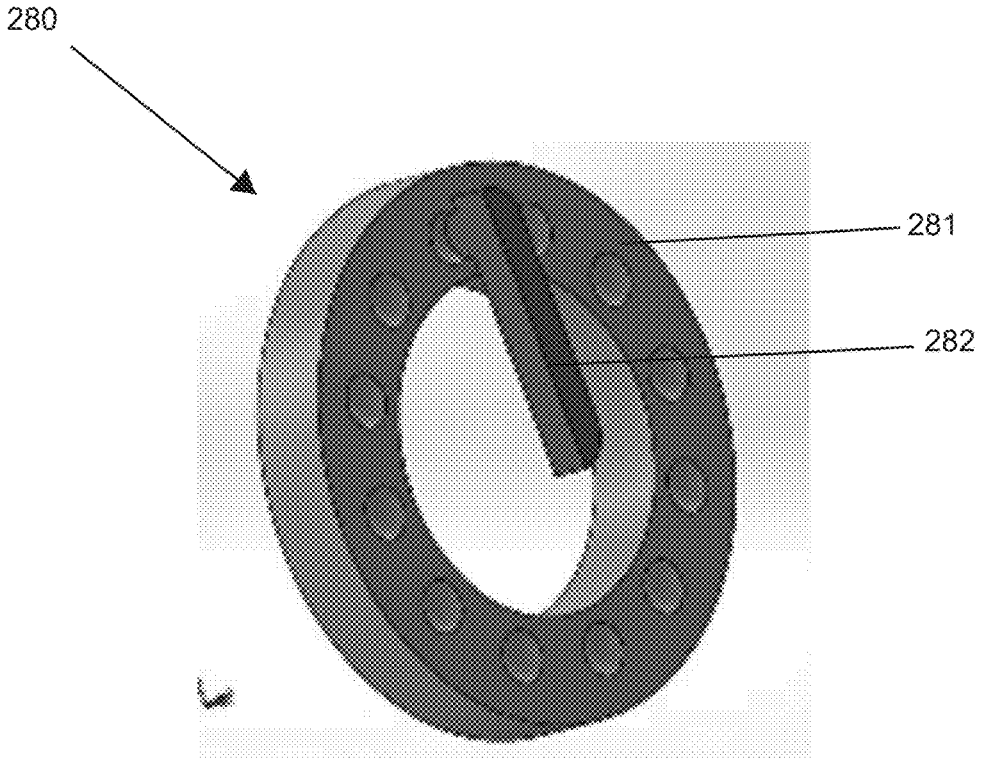

Referring to FIG. 10, a brake sub-system 280 is illustrated. The brake sub-system 280 comprises a disc 281 that is coupled to the cylindrical screen and a brake member 282 that is in frictional contact with a surface of the disc 281. The disc 281 will rotate along with the cylindrical screen and the brake member 282 is stationary. In this embodiment, the disc 281 comprises a plurality of spaced apart detents along one of its surfaces. Furthermore, the brake member 282 comprises a protuberance that intermittently nests within one of the detents as the disc 281 rotates. When the protuberance of the brake member 282 is located within one of the detents, a greater force may be required to cause the disc 281 and the cylindrical screen coupled thereto to rotate. Thus, the interaction between the brake member 282 and the disc 281 of the brake sub-system 280 may reduce the rolling speed of the cylindrical screen and/or may intermittently stop rotation of the cylindrical screen even as it is moved across the skin surface.

Figure 11:
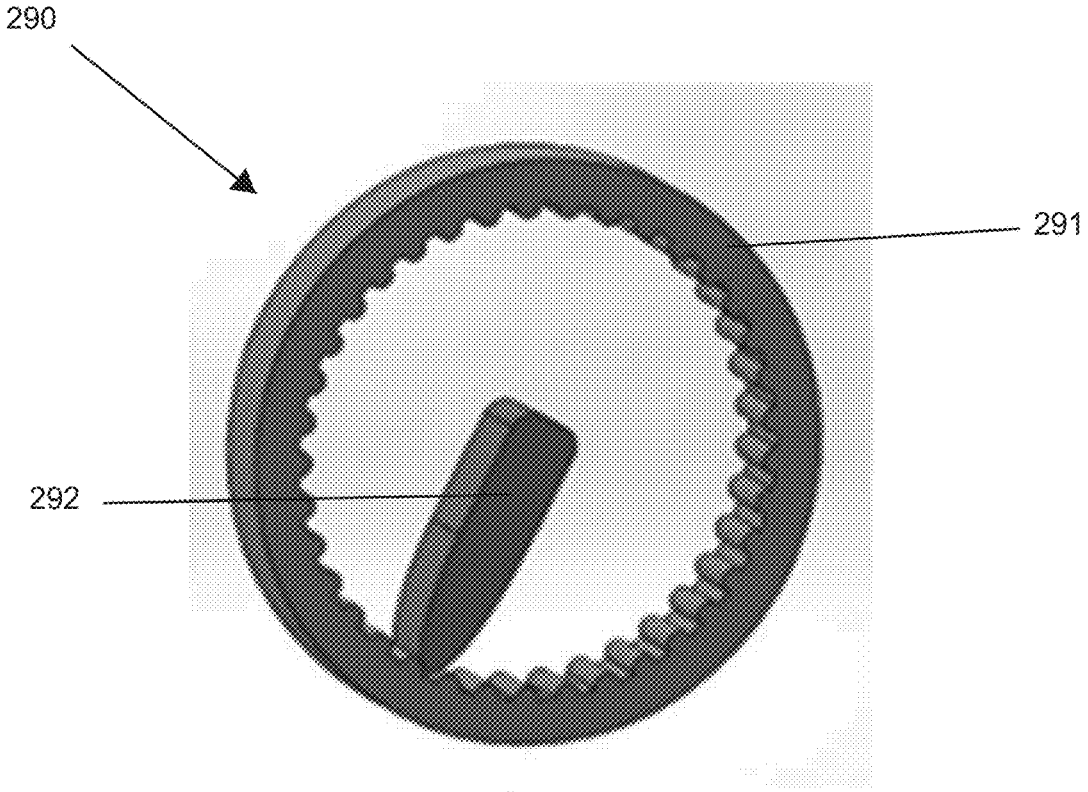

Referring to FIG. 11, yet another brake sub-system 290 is illustrated. The brake sub-system 290 comprises a disc 291 that is coupled to the cylindrical screen and a brake member 292 that is in contact with an inner surface of the disk 291. The disc 291 will rotate along with the cylindrical screen. The disc 291 has a gear-like inner surface with spaced apart bumps/ridges. The brake member 292 may be generally stationary. As the cylindrical screen is moved across a user's skin, the cylindrical screen and the disc 291 will rotate about a rotational axis. During that rotation, the brake member 292 will contact the bumps/ridges on the inner surface of the disc 291 to reduce the rotational velocity of the cylindrical screen and the disc 291. Thus, the brake sub-system 290 will either intermittently slow or stop the rotation of the cylindrical screen as it is being used to shave a skin surface as has been described herein.

Figure 12:
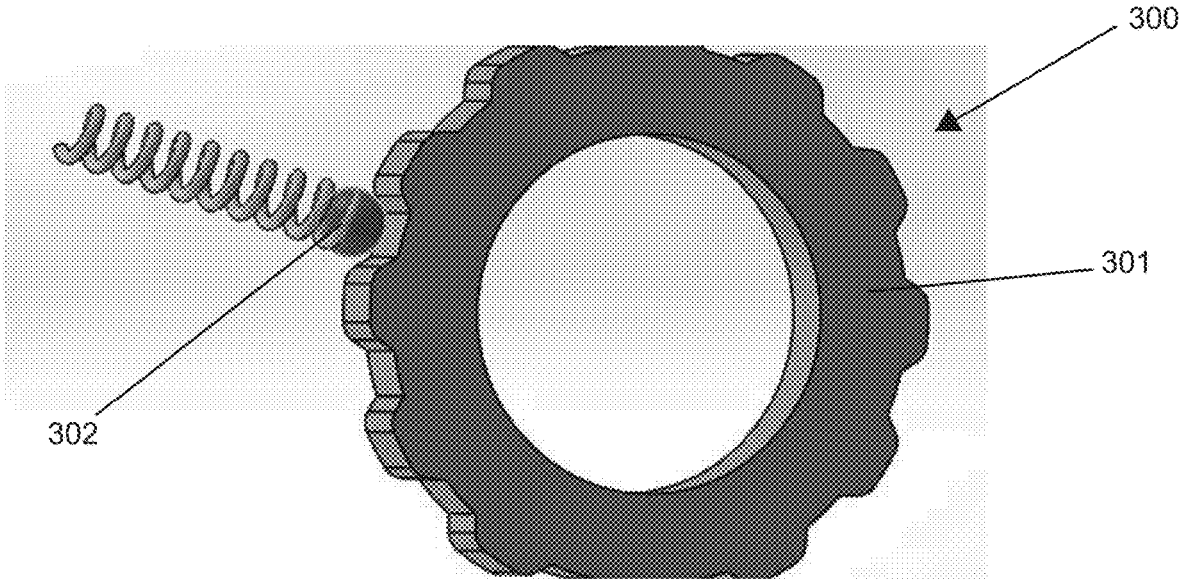

Referring to FIG. 12, another brake sub-system 300 is illustrated. The brake sub-system 300 comprises a disc 301 that is coupled to the cylindrical screen and a brake member 302 that is used to slow or stop rotation of the disc 301 and/or cylindrical screen. In this embodiment, the disc 301 comprises an outer surface having a series of spaced apart bumps/ridges. Furthermore, the brake member 302 comprises a spring-loaded ball member. As the disc 301 rotates during use of the shaving apparatus, the spring loaded ball member will ride along the outer surface of the disc 301. When the spring-loaded ball member is located within the valleys of the outer surface of the disc 301, it may slow the rotational velocity of the disc 301 and hence also the cylindrical screen to which the disc 301 is coupled.

Figure 13:
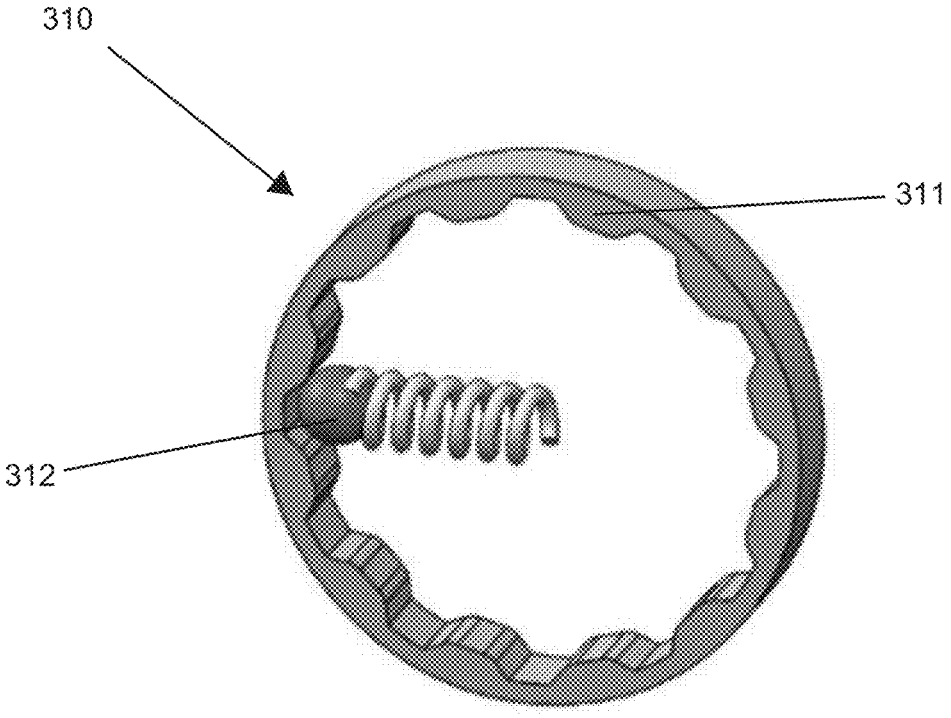

FIG. 13 illustrates a brake sub-system 310 that is similar to the brake sub-system 300. The brake sub-system 310 includes a disc 311 and a brake member 312. The brake member 312 contacts an inner surface of the disc 311 rather than an outer surface as with the brake sub-system 300. Otherwise, the description of the brake sub-system 300 is applicable to the brake sub-system 310.

Figure 14:
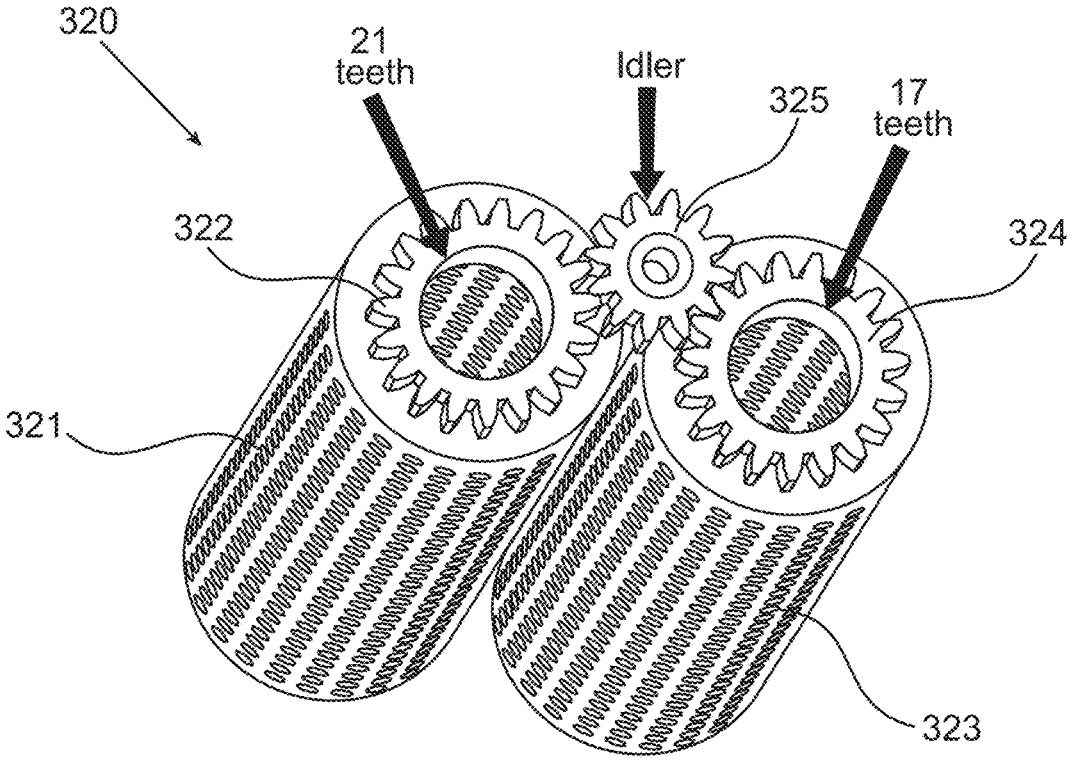
FIGS. 14-16 illustrate systems for achieving relative motion between a cylindrical screen of a shaving apparatus and a skin surface.

Referring to FIG. 14, a shaving system 320 is illustrated, in part. FIG. 14 illustrates a first cylindrical screen 310 comprising a first gear 322, a second cylindrical screen 323 comprising a second gear 324, and an idler 325 coupled to the first and second gears 322, 324. The first and second cylindrical screens 321, 323 form a part of a shaving apparatus, such as the shaving apparatus 100 or the shaving apparatus 200. Thus, although the shaving apparatus is not illustrated in FIG. 14, it should be readily appreciated how the first and second cylindrical screens 321, 323 would be used on a shaving apparatus. As can be seen, each of the first and second cylindrical screens 321, 323 is a hollow cylindrical structure having a cavity. In the fully assembled apparatus, a cutting component such as described above is located within the cavity for cutting hairs that pass through the apertures formed through the first and second cylindrical screens 321, 323.

In this embodiment, the first gear 322 may be the driver gear and the second gear 234 may be the follow or driven gear. Thus, as the first cylindrical screen 321 and the first gear 322 rotate about a rotational axis, they will drive the second cylindrical screen 323 and the second gear 324 to rotate due to the coupling of the idler 325 to the first and second gears 322, 324. Thus, as shown in the drawing, the first gear 322 may have more teeth (21 teeth) than the second gear 324 (17 teeth). In this embodiment, the first cylindrical screen 321 engages the skin surface during use and the first cylindrical screen 321 is made to rotate as the first cylindrical screen 321 is moved along the skin surface. There is nothing impeding the rotation of the first cylindrical screen 321 so the first cylindrical screen 321 will have no motion relative to the skin surface.

The rotation of the first gear 322 will cause the second gear 324 and the second cylindrical screen 323 to rotate. However, the second cylindrical screen 323 will rotate slower than the first cylindrical screen 321 because the second gear 324 has fewer teeth than the first gear 323. A similar result can be achieved by varying the diameter of the first and second cylindrical screens 321, 323 such that the first cylindrical screen 321 has a smaller diameter than the second cylindrical screen 323, which will cause the first cylindrical screen 321 to rotate faster than the second cylindrical screen 323. In any event, this set up will result in the second cylindrical screen 323 rotating with relative motion to the skin surface to enhance the shaving of hairs that are more flat on the skin surface. In this instance both of the first and second cylindrical screens 321, 323 are rotating, but one is rotating slower than the other.

Figure 15:
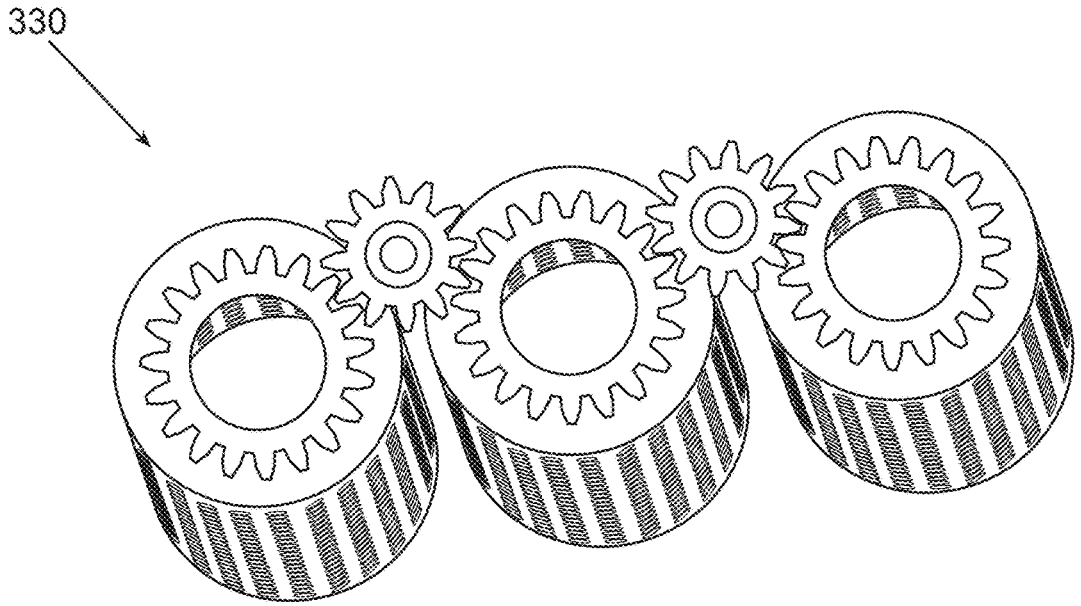

FIG. 15 illustrates a similar shaving system 330 that uses three cylindrical screens and two gears instead of two cylindrical screens and one gear.

Figure 16:
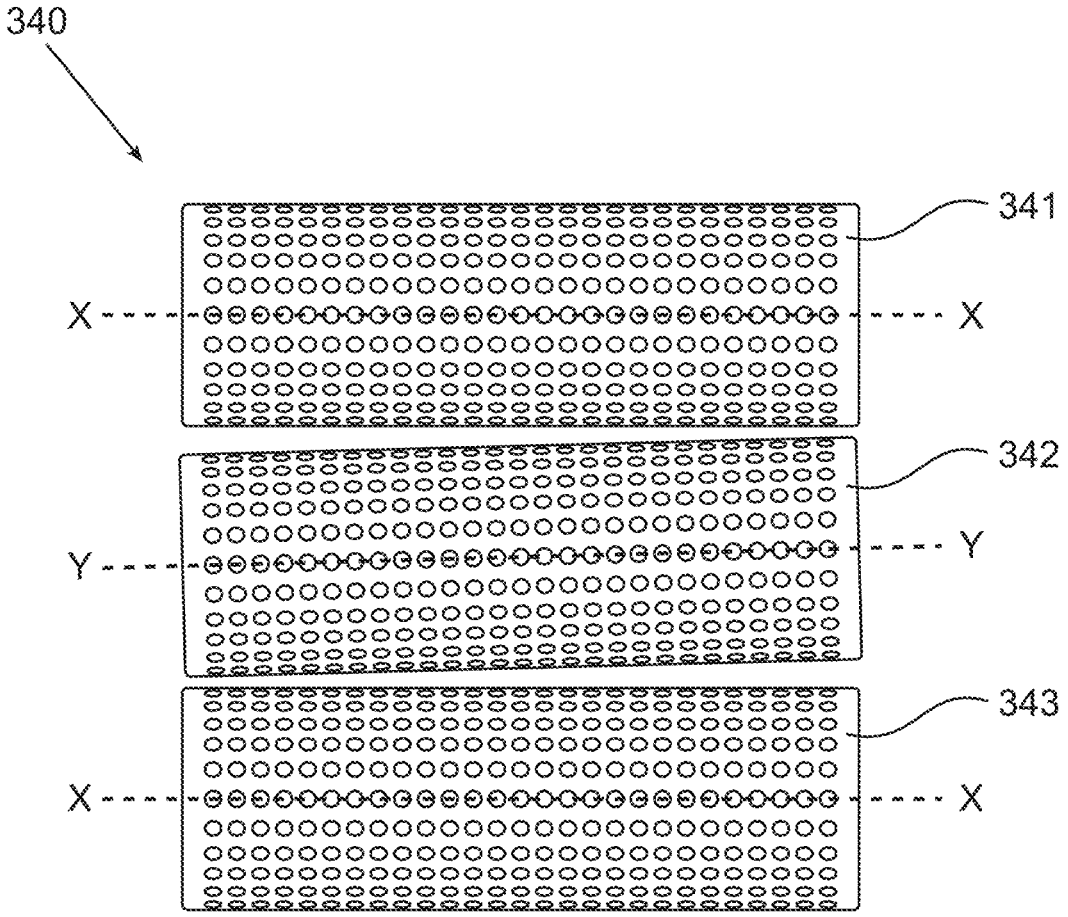

FIG. 16 illustrates a shaving system 340 that includes multiple cylindrical screens, whereby one of the cylindrical screens is not aligned with the other two. Specifically, the shaving system 340 comprises a first cylindrical screen 341, a second cylindrical screen 342, and a third cylindrical screen 343. The first cylindrical screen 341 rotates about a first axis X-X, the second cylindrical screen 342 rotates about a second axis Y-Y, and the third cylindrical screen 343 rotates about a third axis Z-Z. In this embodiment, the first and third axes X-X, Z-Z are parallel to one another, but the second axis Y-Y is non-parallel (i.e., oblique) to the first and third axes X-X, Z-Z. Because the second cylindrical screen 342 is not aligned with the moving direction of the shaving apparatus during use, the second cylindrical screen 342 will skid/drag along the skin surface making it more effective at shaving hairs that are flatter on the skin surface with the first and third cylindrical screens 341, 343 will not skid/drag making them more effective at shaving hairs that are sticking generally straight out from the skin surface.

Figure 17:
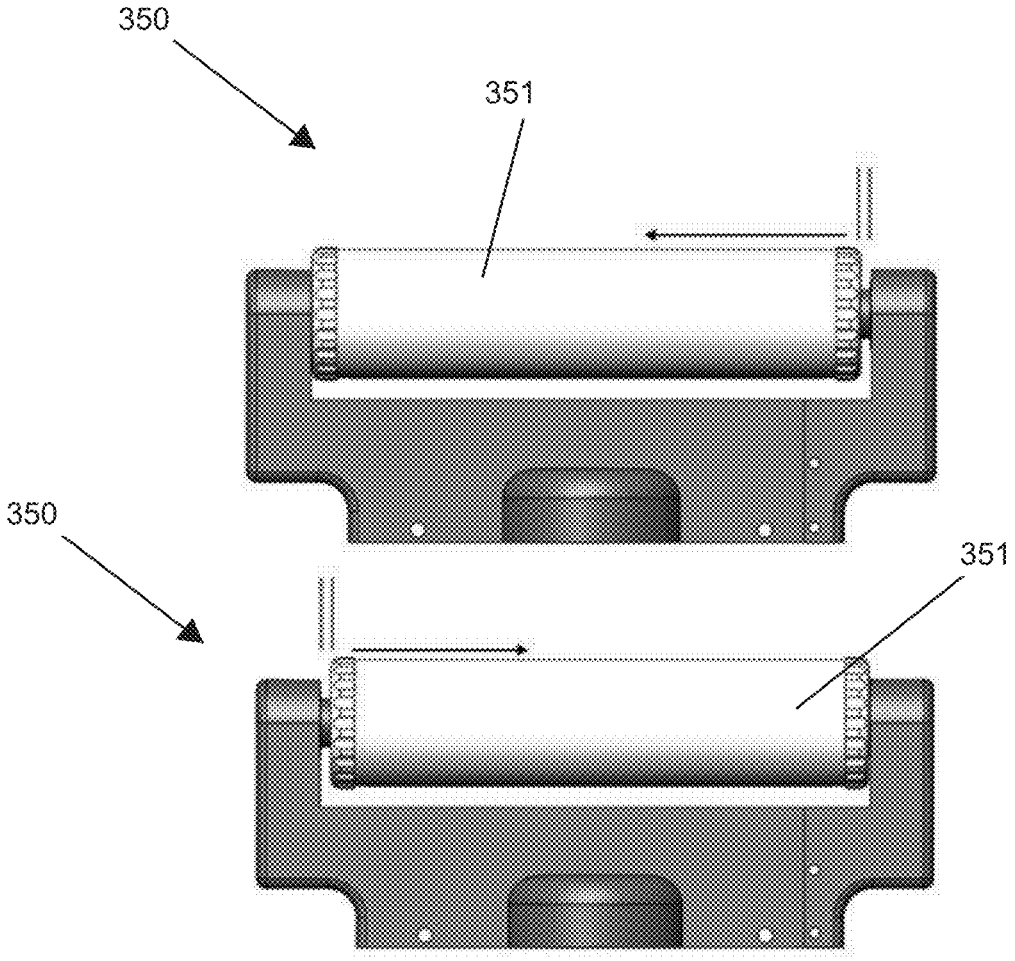
FIG. 17 illustrates a shaving apparatus having a cylindrical screen with linear motion.

FIG. 17 illustrates a shaving apparatus 350 in accordance with another embodiment of the present invention. The shaving apparatus 350 comprises a cylindrical screen 351 similar to that which has been described in the previously described embodiments as well as a cutter component that is not shown in these figures. FIG. 17 illustrates an embodiment whereby the cylindrical screen 351 may be configured to move side-to-side linearly in the direction of its rotational axis. Thus, the cylindrical screen 351 may be configured to rotate as described previously, and in this embodiment the cylindrical screen 351 may also be configured to move side-to-side as shown with the arrows.

In such an embodiment, the rotation of the cylindrical screen 351 along the face by itself may not achieve optimal hair cutting because there is no relative motion between the cylindrical screen 351 and the skin surface because the cylindrical screen 351 rotates as it is moved linearly along the skin surface. Thus, by adding in a side-to-side movement, the cylindrical screen 351 will, in fact, move relative to the skin surface for a more optimal shaving, particularly of the hairs that are laying more flat on the skin surface.

Figure 18:
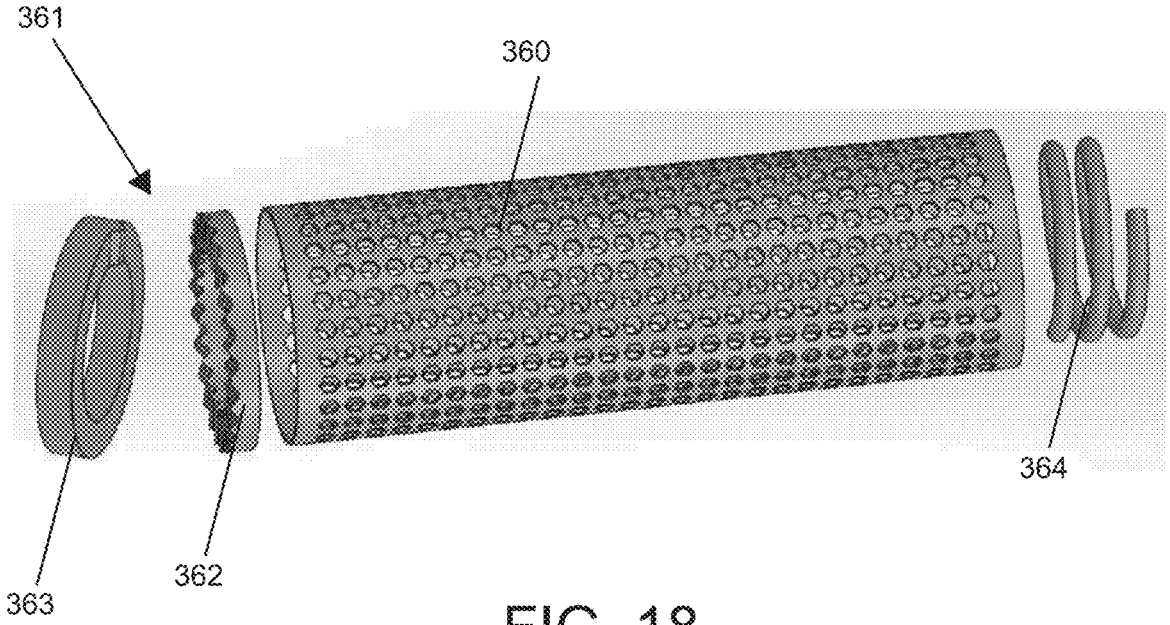
FIGS. 18 and 19 illustrate a cylindrical screen and brake sub-system of a shaving apparatus in accordance with yet another embodiment of the present invention.
Figure 19:
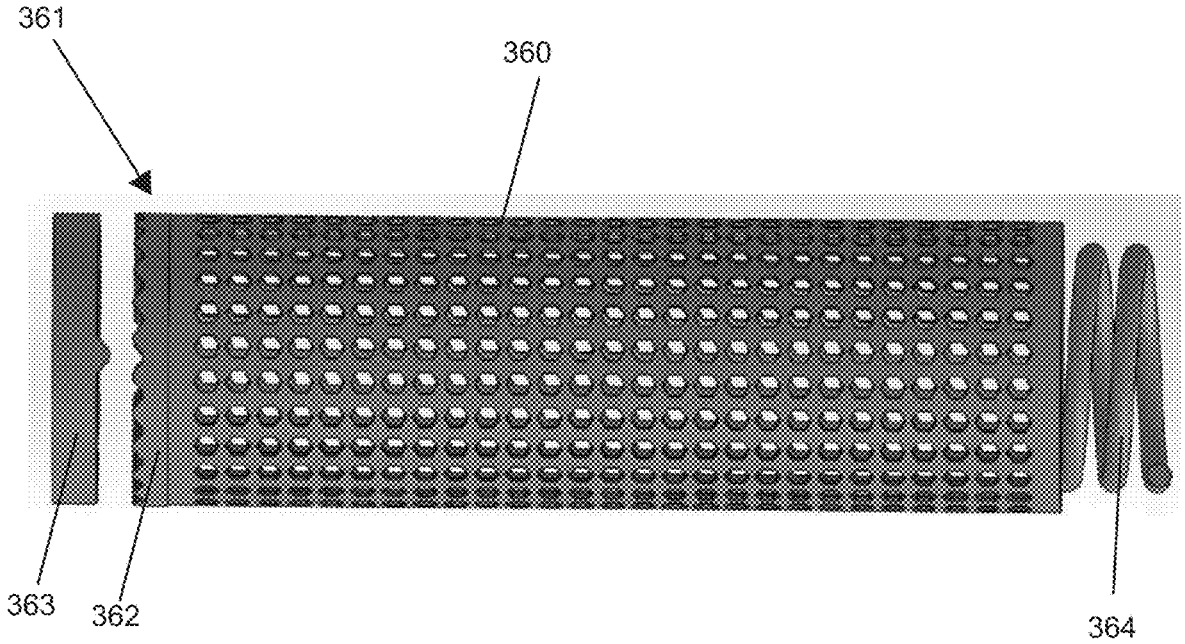

FIGS. 18 and 19 illustrate a cylindrical screen 360 and a brake sub-system 361 in accordance with another embodiment of the present invention. The brake sub-system 361 may comprise a disc 362 that is coupled to the cylindrical screen 360 and rotates with it and a brake member 363 that interacts with the disc 362 to reduce the rotational velocity of the cylindrical screen 360. In this embodiment, there is also a spring 364 coupled to the cylindrical screen 360 that biases the disc 362 into contact with the brake member 363. Thus, in this embodiment as the cylindrical screen 360 rotates, the interaction between the disc 362 and the brake member 363 will: (1) reduce rotational velocity of the cylindrical screen 360; and (2) move the cylindrical screen 360 linearly in a direction of its rotational axis. Specifically, as the protuberance on the brake member 363 moves from being located within one of the valleys of the disc 362 to being located along one of the bumps of the disc 362, this will slow rotation of the cylindrical screen 360 and also cause the cylindrical screen 360 to move to the right. Then, as the protuberance on the brake member 363 moves from being located along one of the bumps of the disc 362 to being located within one of the valleys of the disc 362, the spring force will cause the cylindrical screen 360 to move back to its original position (i.t., to move to the left). Thus, the components of FIGS. 18 and 19 can be used to create the linear movement shown in FIG. 17.

Figure 20:
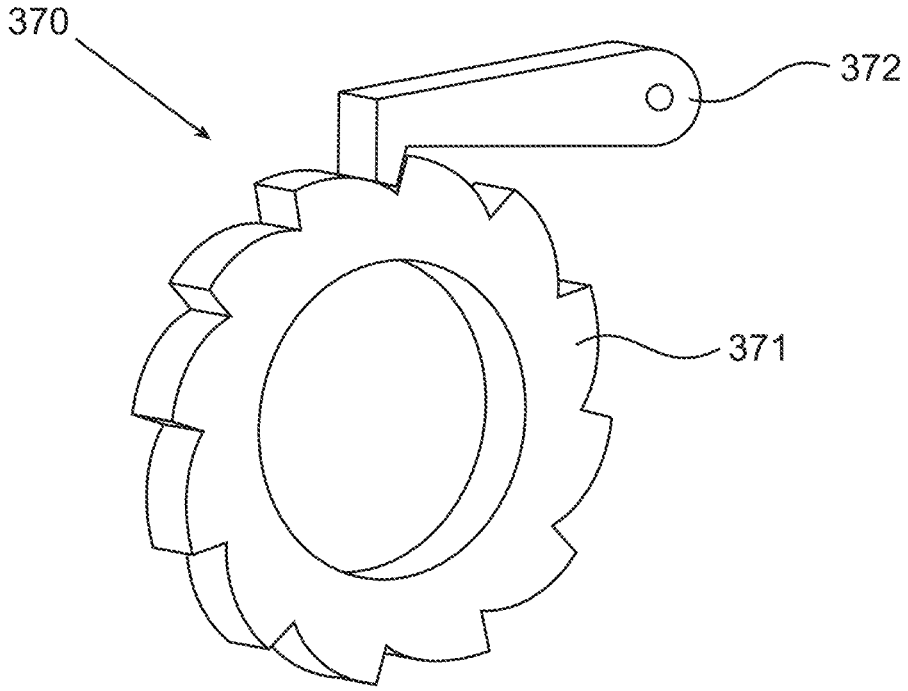
FIGS. 20 and 21 illustrate another embodiment of a brake sub-system.
Figure 21:
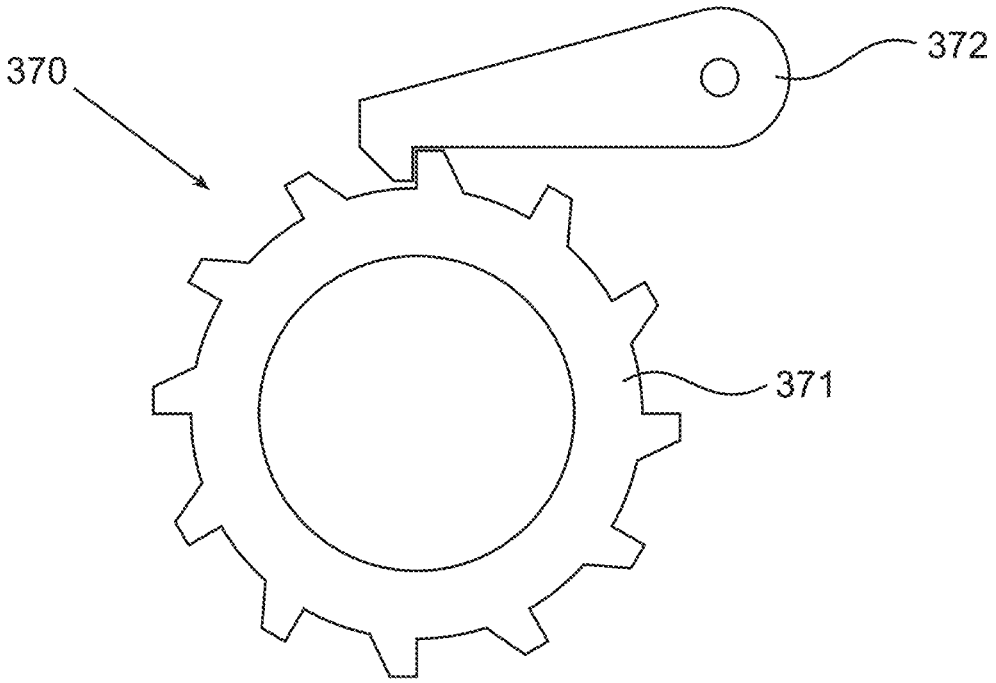

Finally, referring to FIGS. 20 and 21, another embodiment of a brake sub-system 370 is illustrated. The brake sub-system 370 comprises a disc 371 and a brake member 372. In this embodiment, the disc 371 is a ratchet and the brake member 372 is a pawl. The ratchet and pawl configuration of the disc 371 and brake member 372 permits the cylindrical screen to which the disc 371 is attached to rotate in one direction while preventing rotation in the opposite direction. Thus, if the cylindrical screen to which the disc 371 is attached is moved linearly across a skin surface in one direction, the disc 371 and the cylindrical screen will rotate and the pawl will not prevent this rotation. However, if the cylindrical screen to which the disc 371 is attached is moved linearly across the skin surface in the opposite direction, the disc 371 and the cylindrical screen will be prevented from rotating due to the engagement between the pawl and the ratchet.

Thus, this embodiment may be beneficial for shaving both upright hairs and flat hairs. Specifically, the apparatus may be moved in a first direction whereby rotation of the cylindrical screen is permitted to cut the upright hairs and then the apparatus may be moved in a second direction opposite to the first direction whereby rotation of the cylindrical screen is prevented to cut the flat hairs. If the skin surface is a user's face, the shaving apparatus may be moved upwardly to cut upright hairs and then downwardly to cut flat hairs, or vice versa. In this embodiment, users can enjoy shaving with full rolling without irritation and for hard to shave spots can invert the device and shave in a regular mode.

Thus, using the inventive techniques described herein, a single shaving apparatus can be used with the screen moving across the skin in a sequence that includes any of two or more of a full skid, a partial skid, and a full roll. In a full roll, the screen is able to freely rotate during use so that there is no relative motion between the screen and the skin (best for cutting hairs that extend perpendicularly from the skin). In a full skid, the screen does not rotate at all, but rather it is dragged across the skin (best for cutting hairs that lay flat on the skin). In a partial skid, the screen may roll, but in such a way that there is some relative motion between the screen and the skin. Thus, in a partial skid, the screen will roll, but will also be dragged across the skin although to a lesser extent than when in a full skid. In other embodiments, particularly FIGS. 20 and 21, the disclosure is for a device that, in one direction is in full skid and in the other direction is in full roll or partial roll.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A shaving apparatus comprising:

a cylindrical screen comprising an outer surface, an inner surface defining a cavity, and a plurality of openings, the screen being rotatable about a rotational axis;

a cutting component comprising one or more cutting blades located within the cavity of the cylindrical screen, the cutting blades configured to cut hairs that pass through the openings in the cylindrical screen;

wherein upon placing the outer surface of the cylindrical screen into surface contact with a skin surface and moving the shaving apparatus along the skin surface, the cylindrical screen is rotatable about the rotational axis; and a brake sub-system configured to reduce a rotational velocity of the cylindrical screen about the rotational axis as the shaving apparatus is moved along the skin surface, wherein the brake sub-system is intermittently switchable between at least two states:

in a first state the cylindrical screen rotates freely about the rotational axis such that there is essentially no dragging between the cylindrical screen and the skin surface, thereby shaving of upright hairs is facilitated, and in a second state the cylindrical screen rotates about the rotational axis at a controlled reduced rotational velocity as a user moves the apparatus across the skin surface, such that the cylindrical screen is at least partially dragged across the skin surface, thereby shaving of hairs lying essentially flat on the skin surface is facilitated by the one or more cutting blades.

2. The shaving apparatus according to claim 1 wherein the cylindrical screen is a foil screen having a thickness of less than 0.1 mm.

3. The shaving apparatus according to claim 1 further comprising a head portion comprising the cylindrical screen and the cutting component and a handle portion coupled to the head portion and configured for gripping by a user.

4. The shaving apparatus according to claim 3 further comprising:

a power source; and an electric motor operably coupled to the power source and to the cutting component to oscillate the cutting component along a cutting axis to cut hairs that pass through the openings in the cylindrical screen.

5. The shaving apparatus according to claim 4 wherein the power source and the electric motor are located within the handle portion.

6. The shaving apparatus according to claim 3 wherein the head portion further comprises a mounting portion, the cylindrical screen rotatably coupled to the mounting portion.

7. The shaving apparatus according to claim 6 wherein the cylindrical screen is freely rotatable relative to the mounting portion.

8. The shaving apparatus according to claim 1 wherein the cylindrical screen is not operably coupled to a motor.

9. The shaving apparatus according to claim 8 wherein the cylindrical screen is made to rotate about the rotational axis manually due to a linear movement of the shaving apparatus along the skin surface.

10. The shaving apparatus according to claim 1 wherein the brake sub-system comprises an activation mechanism operable by a user.

11. The shaving apparatus according to claim 10 wherein the activation mechanism comprises a push button.

12. The shaving apparatus according to claim 10 wherein the activation mechanism is located on a head portion or on a handle portion coupled to the head portion of the shaving apparatus.

13. The shaving apparatus according to claim 1 wherein the cylindrical screen comprises a first cylindrical screen comprising a first gear, a second cylindrical screen comprising a second gear, and wherein the shaving apparatus comprises an idler coupled to the first and second gears, wherein rotation of the first gear causes the second gear and the second cylindrical screen to rotate slower than the first cylindrical screen, to enhance the shaving of the hairs lying flat on the skin surface.

14. The shaving apparatus of claim 1 wherein the cylindrical screen comprises multiple cylindrical screens, wherein a second screen of the multiple cylindrical screens is not aligned with others of the multiple cylindrical screens, thereby causing the second screen to skid/grad along the skin surface, hence shaving of the lying hairs is facilitated by the second screen and shaving of the upright hairs is facilitated by the others of the multiple cylindrical screens.

15. The shaving apparatus of claim 1 wherein the brake sub-system comprises a disc and a brake member, wherein the disc comprises an outer surface with alternating raised portions and valley portions, and wherein the disc is coupled to the cylindrical screen, such that in operation, as the disc rotates due to the rotation of the cylindrical screen, a distal portion of the brake member enters into and out of the valleys of the outer surface of the disc.

16. The shaving apparatus of claim 1 wherein the brake sub-system comprises a disc and a brake member, wherein the brake member is positioned within an inner surface of the disc, and wherein the brake member is stationary, such that in operation, as the disc rotates, opposing ends of the brake member will alternatingly be in contact and not in contact with the inner surface of the disc.

17. The shaving apparatus of claim 1, wherein the brake sub-system comprises a disc having a plurality of spaced apart detents, and a brake member having a protuberance that intermittently nests within one of the plurality of detents as the disc rotates, such that the brake member is in frictional contact with the disc, and wherein the disc is coupled to the cylindrical screen such that in operation the disc rotates along the cylindrical screen while the brake member is stationary.

18. The shaving apparatus of claim 1, wherein the brake sub-system comprises a disc coupled to the cylindrical screen, and a brake member that is used to slow or stop rotation of the disc and/or the cylindrical screen, wherein the disc comprises an outer or an inner surface having a series of spaced apart bumps/ridges, and wherein the brake member comprises a spring-loaded ball member, such that in operation the spring-loaded ball member rides along the outer or the inner surface of the disc.

19. The shaving apparatus of claim 1, wherein the second state comprises reducing the rotational velocity of the cylindrical screen to zero, such that the cylindrical screen is dragged across the skin surface without rotating about the rotational axis, while maintaining a relative linear motion between the cylindrical screen and the skin surface.

20. The shaving apparatus of claim 1, wherein when the shaving apparatus is moved in a first direction the cylindrical screen rotates freely, such that there is essentially no dragging between the cylindrical screen and the skin surface, to facilitate shaving of the upright hairs, and when the shaving apparatus is moved in a second direction opposite to the first direction, the rotational velocity of the cylindrical screen is reduced, such that the cylindrical screen is at least partially dragged across the skin surface, to facilitate shaving of the hairs lying essentially flat on the skin surface is facilitated by the one or more cutting blades.

21. A head portion of a shaving apparatus comprising:

a mounting portion;

a cylindrical screen comprising a plurality of openings, the cylindrical screen rotatably coupled to the mounting portion so as to be rotatable about a rotational axis;

a brake sub-system coupled to the cylindrical screen and configured to intermittently reduce a rotational velocity of the cylindrical screen about the rotational axis, wherein the brake sub-system is intermittently switchable between at least two states:

in a first state the cylindrical screen rotates freely about the rotational axis, such that there is essentially no dragging between the cylindrical screen and the skin surface, thereby shaving of upright hairs is facilitated, and in a second state the cylindrical screen rotates about the rotational axis at a controlled reduced rotational velocity as a user moves the apparatus across the skin surface, such that the cylindrical screen is at least partially dragged across the skin surface, thereby shaving of hairs lying essentially flat on the skin surface is facilitated by one or more cutting blades; and a cutting component comprising the one or more cutting blades, the cutting component configured to cut hairs that pass through the openings in the cylindrical screen.

22. The head portion of the shaving apparatus according to claim 21 wherein the cylindrical screen is configured to rotate about the rotational axis, relative to the mounting portion, in response to a linear force being applied thereto as the shaving apparatus is moved along the skin surface.

23. The shaving apparatus according to claim 21 wherein the brake sub-system comprises an activation mechanism operable by a user.

24. The shaving apparatus according to claim 23 wherein the activation mechanism comprises a push button.

25. A method of shaving comprising:

pressing a cylindrical screen of a shaving apparatus into contact with a skin surface, the cylindrical screen comprising a plurality of openings that allow hairs on the skin surface to pass through the cylindrical screen;

moving the shaving apparatus along the skin surface while the cylindrical screen is in surface contact with the skin surface, thereby causing the cylindrical screen of the shaving apparatus to rotate about a rotational axis;

intermittently switching reducing a rotational velocity of the cylindrical screen about the rotational axis with a brake sub-system that is operably coupled to the cylindrical screen, the brake sub-system is intermittently switchable between at least two states:

a first state in which the cylindrical screen rotates freely about the rotational axis, such that there is essentially no dragging between the cylindrical screen and the skin surface, thereby shaving of upright hairs is facilitated, and a second state in which the cylindrical screen rotates about the rotational axis at a controlled reduced rotational velocity as a user moves the apparatus across the skin surface, such that the cylindrical screen is at least partially dragged across the skin surface, thereby shaving of hairs lying essentially flat on the skin surface is facilitated; and cutting the hairs that pass through the cylindrical screen with a cutting component.

26. The method according to claim 25 further comprising powering a motor of the shaving apparatus to cause the cutting component of the shaving apparatus to oscillate along a linear axis to facilitate cutting of the hairs by the cutting component.

27. The method of shaving according to claim 25 wherein there is intermittent relative motion between the cylindrical screen and the skin surface as the shaving apparatus is moved along the skin surface.

28. The method according to claim 25 wherein the cylindrical screen rotates about the rotational axis entirely due to the movement of the shaving apparatus along the skin surface while the cylindrical screen is in surface contact with the skin surface.

29. The shaving apparatus of claim 28, wherein when a first end of the opposing ends of the brake member is in contact with the inner surface of the disc, and a second end of the opposing ends of the brake member is not in contact with the inner surface of the disc, and vice versa, consequently constantly reducing a rotational velocity of the disc and of the cylindrical screen.

* * * * *